US005329345A

United States Patent [19]

Nagatani et al.

[11] Patent Number: 5,329,345

[45] Date of Patent: Jul. 12, 1994

[54] COPYING APPARATUS WITH AUTOMATIC DOCUMENT HANDLING DEVICE

[75] Inventors: Kentaro Nagatani, Toyohashi; Tomokazu Kato, Toyokawa; Keiichi Nomura, Amagasaki; Yoshiaki Takano, Toyohashi; Syuzi Maruta, Toyokawa; Kazuhiro Araki; Takashi Noda, both of Okazaki, all of Japan

[73] Assignee: Minolta Camera Kabushiki Kaisha, Osaka, Japan

[21] Appl. No.: 962,633

[22] Filed: Oct. 16, 1992

[30] Foreign Application Priority Data

Oct. 18, 1991 [JP] Japan ..... 3-271322

[51] Int. Cl.[5] ..... G03G 21/00

[52] U.S. Cl. ..... 355/316; 355/321

[58] Field of Search ..... 355/308, 309, 311, 321, 355/316, 317

[56] References Cited

U.S. PATENT DOCUMENTS

| | | | |
|---|---|---|---|
| 4,912,518 | 3/1990 | Matsuo et al. | 355/317 |
| 5,204,724 | 4/1993 | Nakabayashi et al. | 355/308 |
| 5,223,905 | 6/1993 | Yamada et al. | 355/316 |

FOREIGN PATENT DOCUMENTS

| | | |
|---|---|---|
| 60-140364 | 7/1985 | Japan . |
| 64-34821 | 2/1989 | Japan . |

*Primary Examiner*—A. T. Grimley
*Assistant Examiner*—Nestor R. Ramirez
*Attorney, Agent, or Firm*—Burns, Doane, Swecker & Mathis

[57] ABSTRACT

A copying machine has an automatic document handling device including a document tray, first transport member for feeding original documents placed on said document tray to a predetermined position located between said document tray and an image reading position, second transport member for further feeding original documents fed to the predetermined position by the first transport member to the image reading position, a sensor detecting means for detecting the presence of original documents placed on the document tray and feeding member for feeding a copy paper to a fixed position within a copy paper feeding path before the original document is fed to the image reading position by the second transport member.

When the presence of said third original document disposed on the document tray is detected by said sensor after a second original document has been fed from said document tray to the predetermined position via said first transport member during the copying operation for a first original document fed to the image reading position via said second transport member, the feeding member feeds the copy paper corresponding to a third original document.

7 Claims, 27 Drawing Sheets

COPYING APPARATUS WITH AUTOMATIC DOCUMENT HANDLING DEVICE

BACKGROUND OF THE INVENTION

1. Field of the Invention

The present invention relates to a copying apparatus with an automatic document handling device.

2. Description of the Related Art

Copying apparatus provided with automatic document handling devices have appeared in recent years. In copying apparatus of the aforesaid type, original documents placed on a document tray are automatically detected, and said originals are automatically fed during the copying operation.

In the aforesaid copying apparatus having an automatic document handling device capable of detecting the presence of original documents, when two sheets of an original document are present, a copy sheet is fed for the second sheet of the document and placed at a predetermined position within the feed path prior to the end of the copying operation of the first sheet of the document (hereinafter this operation is referred to as "preliminary paper supply"). Therefore, the copy paper corresponding to the second document can be fed to the transfer portion synchronously with the start of the scan for said second document, thereby eliminating wasted time waiting for said copy sheet to be fed, and improving the efficiency of the copying operation.

When the feed path extending from the paper cassette to the transfer portion is lengthened, not only can a copy paper corresponding to the second original be preliminarily supplied, but a copy paper corresponding to the third original also can be fed as a preliminary paper supply into the feed path. If, at this time, the presence of a third original disposed on the document tray cannot be detected, a preliminary paper supply for a copy paper corresponding to said third original cannot be accomplished, and a wide spacing occurs between the copy paper for second original and the copy paper for the third original. Even if the presence of a third original disposed on the document tray can be detected, a pre-transported copy paper will be wasted when said third original is pulled from the tray after having been detected.

SUMMARY OF THE INVENTION

An object of the present invention is to provide a copying apparatus having a high copy production capacity.

A further object of the present invention is to provide a copying apparatus capable of efficient copying without wasting time waiting for the feeding of copy paper.

A still further object of the present invention is to provide a copying apparatus which reliably detects the presence of originals disposed on a document tray, and is capable of efficient copying without wasting pre-transported copy paper.

These objects of the present invention are accomplished by providing a copying apparatus comprising:

an automatic document handling device incorporating a document tray, first transport means, and second transport means, wherein said first transport means feeds originals placed on said document tray to a predetermined position located between said document tray and an image reading position, and said second transport means feeds originals fed to a predetermined position by said first transport means to an image reading position;

a detecting means for detecting the presence of original documents placed on said document tray;

a feeding means for feeding copy paper to a predetermined position within the feed path before the original is fed to the image reading position by said second transport means;

a first control means for controlling said feeding means so as to feed copy paper corresponding to a third original when the presence of a third original disposed on the document tray is detected by said detecting means;

a second control means for controlling said detecting means to detecting the presence of a third original disposed on the document tray after a second original has been fed from said document tray to a predetermined position via said first transport means during the copying operation for a first original fed to the image reading position.

These and other objects, advantages and features of the invention will become apparent from the following description thereof taken in conjunction with the accompanying drawings which illustrate specific embodiments of the invention.

BRIEF DESCRIPTION OF THE DRAWINGS

In the following description, like parts are designated by like reference numbers throughout the several drawings.

DETAILED DESCRIPTION OF THE PREFERRED EMBODIMENTS

The preferred embodiments of the invention are described hereinafter with reference to the accompanying drawings.

Copying Apparatus Construction

Figure 1:
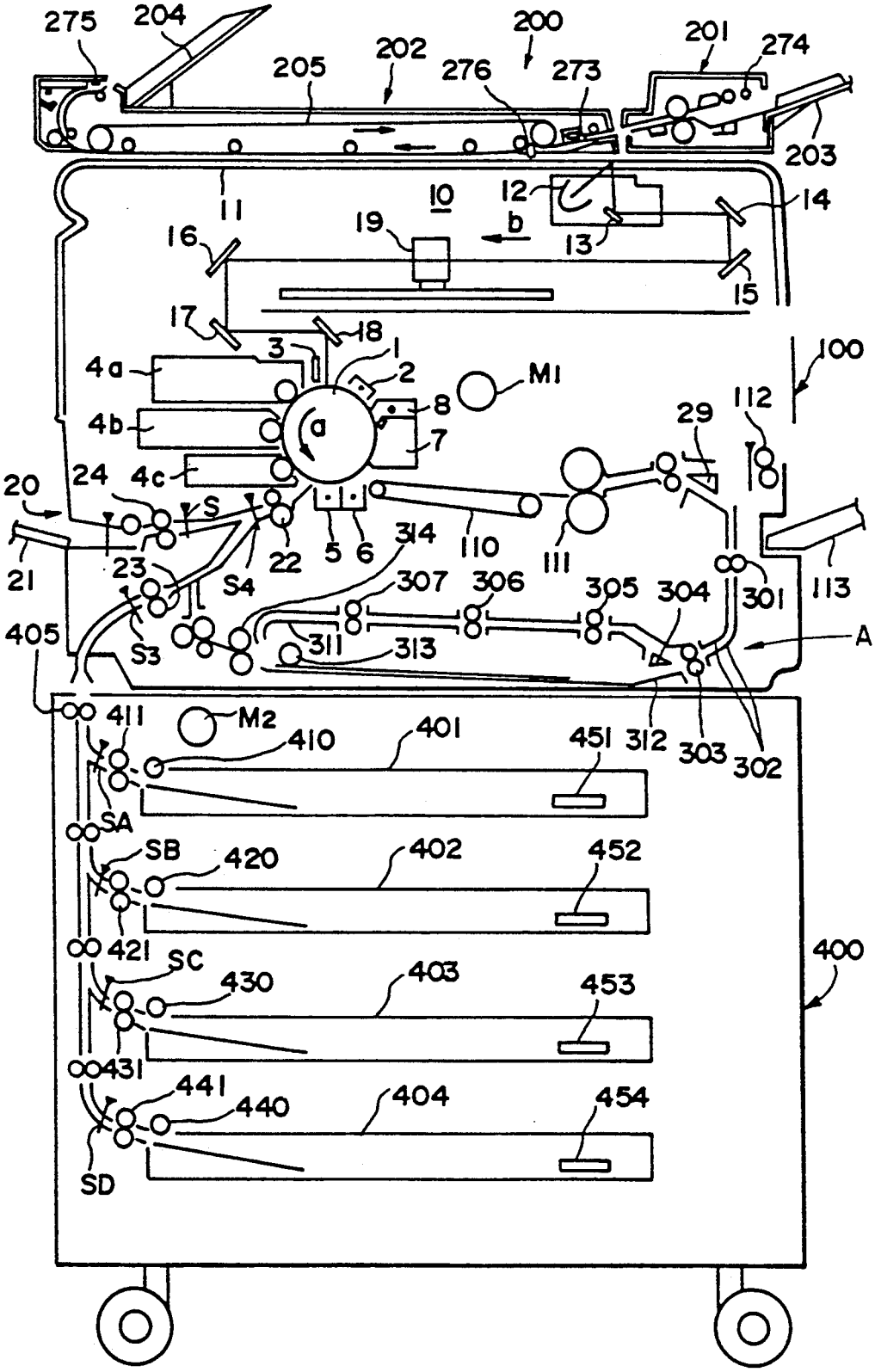
FIG. 1 is a section view showing the general construction of the copying apparatus of the present invention.

FIG. 1 shows the general construction of the copying apparatus of the present invention.

A photosensitive drum 1 which is rotatable in the arrow a direction is provided in the center of the copying apparatus body 100. Sequentially disposed around the periphery of the photosensitive drum 1 are an eraser lamp 8, charger 2, eraser 3, developing units 4*a*, 4*b* and 4*c* each of which develop in a different color, transfer charger 5, separation charger 6, and cleaning device 7. A photosensitive layer provided on the surface of the photosensitive drum 1 is uniformly charged as it passes the eraser lamp 8 and charger 2, and is then exposed to image exposure light via the scanning optical unit 10 so as to form an electrostatic latent image on said photosensitive surface of drum 1. A toner image is then formed by developing said latent image using one or more of the developing units 4*a*~4*c*.

The optical unit 10 comprises an exposure lamp 12, mirrors 13, 14 and 15, lens 19, and mirrors 16, 17 and 18, and is provided beneath the platen glass 11 so as to scan the image of an original document placed on the glass platen 11. The exposure lamp 12 and moveable mirror 13 are driven so as to move as an integrated unit in the arrow b direction at a speed V/m, whereas the moveable mirrors 14 and 15 are driven so as to move as an integrated unit in the arrow b direction at a speed v/2m, wherein v is the circumferential speed of the photosensitive drum 1, and m is the copy magnification.

Copy paper is fed into the body of the copying apparatus 100 via the automatic paper supply device 400 which has vertically arranged four-stage cassette portions 401 to 404 provided at the bottom portion of the copy apparatus body 100, or by means of a manual feed device 20 provided at the top of said copying apparatus body 100. The copy paper is temporarily stopped at the pair of timing rollers 22, then fed by said rollers to the transfer portion synchronously with the electrostatic latent image formed on the surface of the photosensitive drum 1, whereupon the toner image is transferred from the surface of the drum 1 onto the surface of the copy paper via the transfer charger 5. Thereafter, the copy paper is separated from the surface of the photosensitive drum 1 via the separation charger 6, transported via the transport belt 110 to the fixing unit 111 where the toner image is fixed to the copy paper which is thereafter discharged to the discharge tray 113.

After the completion of the aforesaid toner image transfer, the residual toner and electric charge are removed from the surface of the photosensitive drum 1 by means of the cleaning unit 7 and the eraser 8, in preparation for the next copy process.

The automatic paper supply device 400 and the manual feed device 20 are both selectively usable, one at a time. (The description of the manual feed device is omitted from the following explanation.) In the automatic paper supply device 400, the feed rollers 410, 420 or 430 are actuated to feed a sheet of copy paper, and the optical unit 10 is actuated in conjunction with said sheet transport so as to feed the copy paper synchronously with the image formation. The actuation of the feed rollers 410 and the like, roller 411, transport roller pair 405, intermediate roller pair 23 are controlled in conjunction with the timing roller pair 22.

The automatic document feeding device (ADF) 200 is provided on the top of the copying apparatus body 100. The ADF 200 comprises a document feeding portion 201 and a document feeding portion 202. In the document feeding portion 201, the originals placed on the document tray 203 by the user are fed therefrom one sheet at a time. In the document feeding portion 202, a fed original is transported onto the top surface of the platen glass 11 via the transport belt 205 so as to stop at a predetermined position thereon, and after scanning is completed, said original is transported to the discharge tray 204. The document feeding portion 202 also may be used individually as a manual document feeding device.

Furthermore, the document feeding portion 202 is mounted on the top of the copying apparatus body 100 so as to be openable relative to the apparatus body 100 to expose the platen glass 11. A magnet (not illustrated) is provided on the apparatus body 100 so that said magnet is detected when the document feeding portion 202 is closed and turns on a set switch 276 which comprises a reed switch. When the document feeding portion 202 is open, the set switch 276 is turned OFF. Thus, the open/close operation of the document feeder portion 202 as a document cover is detectable.

The construction of the intermediate tray unit A is briefly described hereinafter. The intermediate tray unit A comprises a switching block, transport block, inverting block, intermediate tray block, and re-feeding block.

When the duplex copy mode is selected, the switching lever 29 is switched to a predetermined position, and the copy paper P used for one-sided copies or portion thereof is guided from the transport roller pair 301 via the guide plate 302 so as to be fed to the transport rollers 303.

When the duplex copy mode is selected, the switching lever 304 is set at a predetermined position, and the copy paper P is transported to the transport block guided by the top surface of said switching lever 304, transported to the left side of the drawing via the transport rollers 305, 306 and 307 while being guided by the guide plate, then is inverted by the inverting guide 311 so as to be delivered to the intermediate tray 312 with the copy surface facing upward. The copy paper P is then adjusted on the intermediate tray 312 and re-transported one sheet at a time by the re-feed roller 313.

Figure 2:
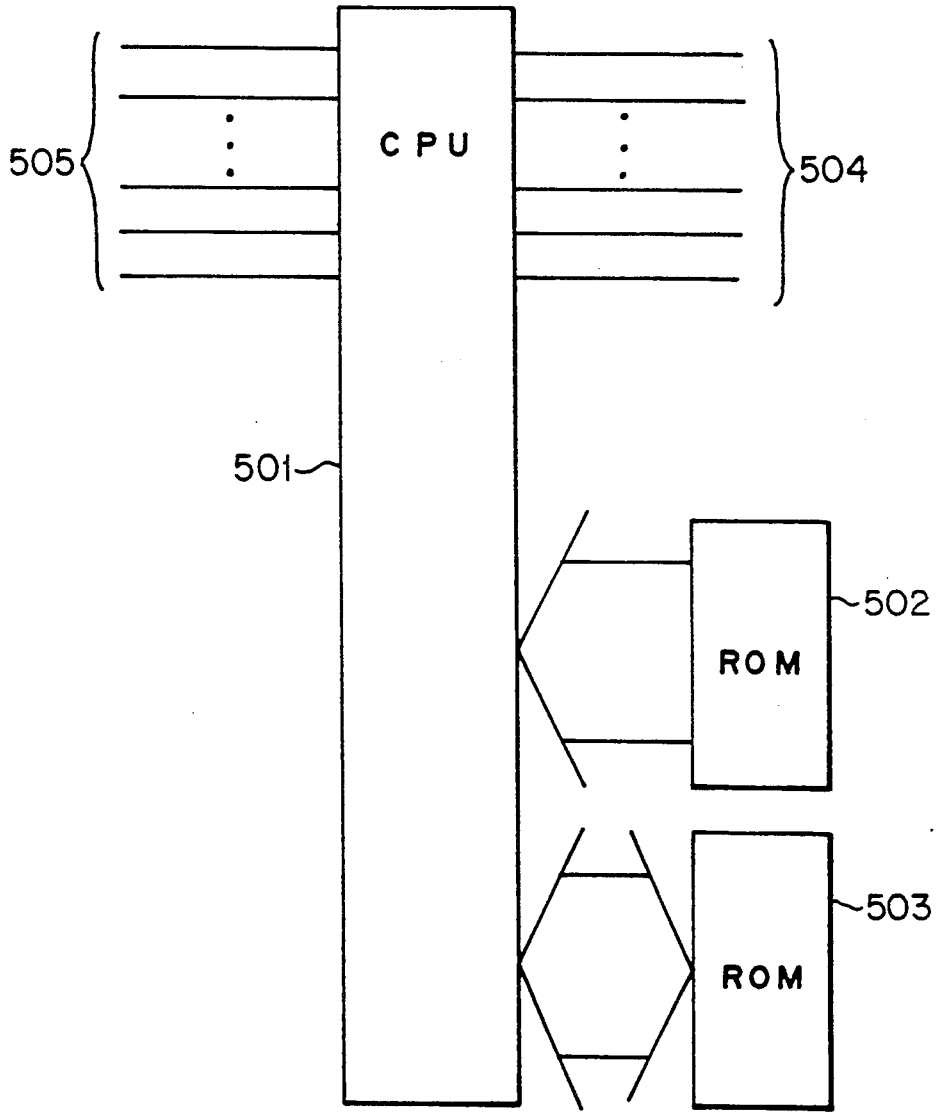
FIG. 2 is a block diagram of the control portion of the copying apparatus.

FIG. 2 shows the control portion of the copying apparatus. The CPU 501 generally detects and controls the various types of motors, rollers, sensors, and input from the operation panel (not illustrated) of the copying apparatus 100. The read only memory (ROM) 502 and random access memory (RAM) 503 are areas for storing the programs and data (flags and the like) required to execute the controls of the CPU 501.

The input pin group 504 contains pins for receiving key input from the operation panel (not illustrated), main switch operation, detection signals from the various types of sensors SA, SB, SC, SD, S3, S4, 273, 274, and 275, and motor signals and trouble signals.

The output pin group 505 contains pins for driving the rollers and motors and the like necessary to accomplish the copy operation, pins for lighting the display means on the operation panel (not illustrated), and pins for operating the heating roller of the fixing device 111.

Document and Copy Paper Transport

In the copying apparatus having the construction shown in FIG. 1, preliminary paper supply of three sheets of copy paper can be accomplished due to the long feed path extending from the installed copy paper cassette to the photosensitive drum 1. The number of copy sheet which are pre-transportable in the preliminary paper supply is determined by the length of the feed path and the size of the copy paper.

Three individual sensors 273,274 and 275 for detecting original documents are provided in the automatic document feeding device 200 (refer to FIG. 1). The original document exchange state is entered by depressing the print key or the timing of completing the scan of the original. A first original is placed on the platen glass 11, a second original is fed to a position near the sensor 273 (this operation is hereinafter referred to as "pre-transport"), and a third original is disposed on the document tray 203. The sensor 273 verifies the transport of the original to the glass platen 11 by detecting the trailing end of the original, and detects the pre-transport of a second original by detecting the passage of the leading end of the second original. The sensor 274 detects the presence of originals placed in the document tray 203. The sensor 275 detects the transport of originals to the document discharge tray 204. Thus, the state of the original documents (placement of an original on the platen glass 11, advancement of an original to the platen glass 11, pre-transport of an original and discharge of an original) can be detected by means of the aforesaid sensors. Therefore, the number of original documents waiting to be copied (a maximum of three originals) is determined (refer to FIGS. 7~9 and 13), and in accordance with said determination the originals are transported via the automatic document feeding device 200 (refer to FIGS. 5 and 6).

The preliminary paper supply of the copy paper can be accomplished in accordance with the original document information obtained in the manner described above. Therefore, the copy paper supply information shown in FIG. 17 is generated in accordance with the flow charts shown in FIGS. 14~21. The aforesaid copy paper supply information comprises an available flag $U_N$ which is set when an available original is present and a paper supply end flag $K_N$, relative to each of the copy papers ($N=1\sim3$) for the number of originals remaining to be copied.

Figure 21:
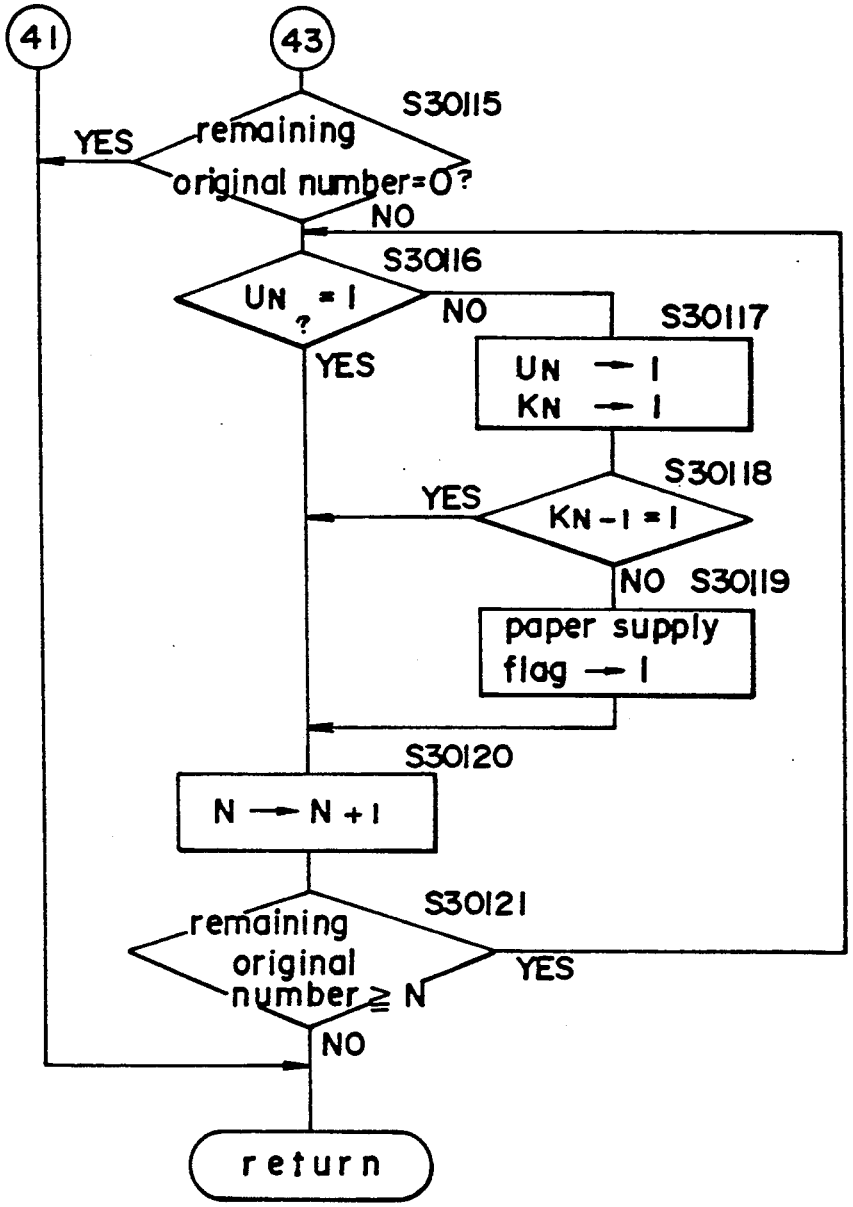
FIG. 21 is a flow chart showing a part of the paper supply information production process.
Figure 25:
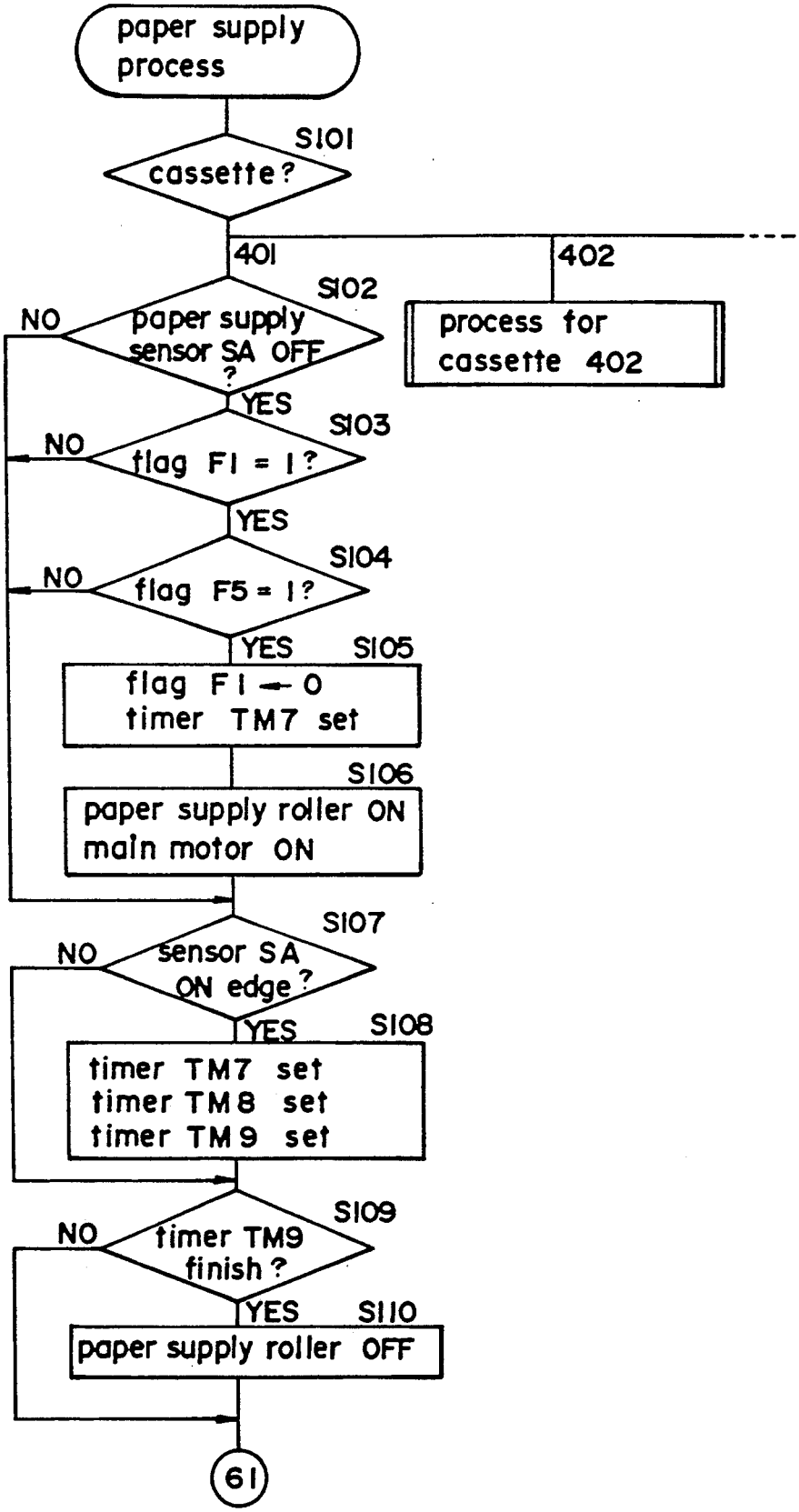
FIG. 25 is a flow chart showing a part of the paper supply process.

When there is an unfed sheet of copy paper for a waiting original, the preliminary paper supply is accomplished for the waiting original (refer to FIGS. 21 and 25). In the copying apparatus, the sensor S4 detects the copy paper up to the timing roller 22. The copy paper feed sensors SA, SB, SC and SD detect the feeding of the copy paper from the cassettes 401, 402, 403 and 404, respectively. the preliminary paper supply of the copy paper is accomplished using the aforesaid sensors. The paper supply interval is set so as to avoid having a copy paper sheet overtake the previous supplied copy paper. More specifically, a third copy paper is pre-fed in the preliminary paper supply for a third original when a third original is detected on the document tray 203 during the copying operation of the first original and after the start of the pre-transporting of the second original from the document tray 203.

Even when the duplex original mode is specified, the originals are pre-transported up to the third original and the processing is executed in accordance with a number of copies that is double the number of originals.

When a third original placed on the document tray 203 is removed therefrom, the sensor 274 detects the pulling of the original placed on the document tray 203. When the original is pulled, the copy paper supply information is converted so as to stop the copy paper supply operation for the removed third original (refer to FIG. 15). In the present embodiment, the pulling detection performed by the sensor 274 is accomplished not less than three times for the preliminary paper supply is executed for a third original so as to preclude the erroneous operation of the sensor 274.

Copying Apparatus Control Flow

The control of the copying apparatus is described hereinafter.

Figure 3:
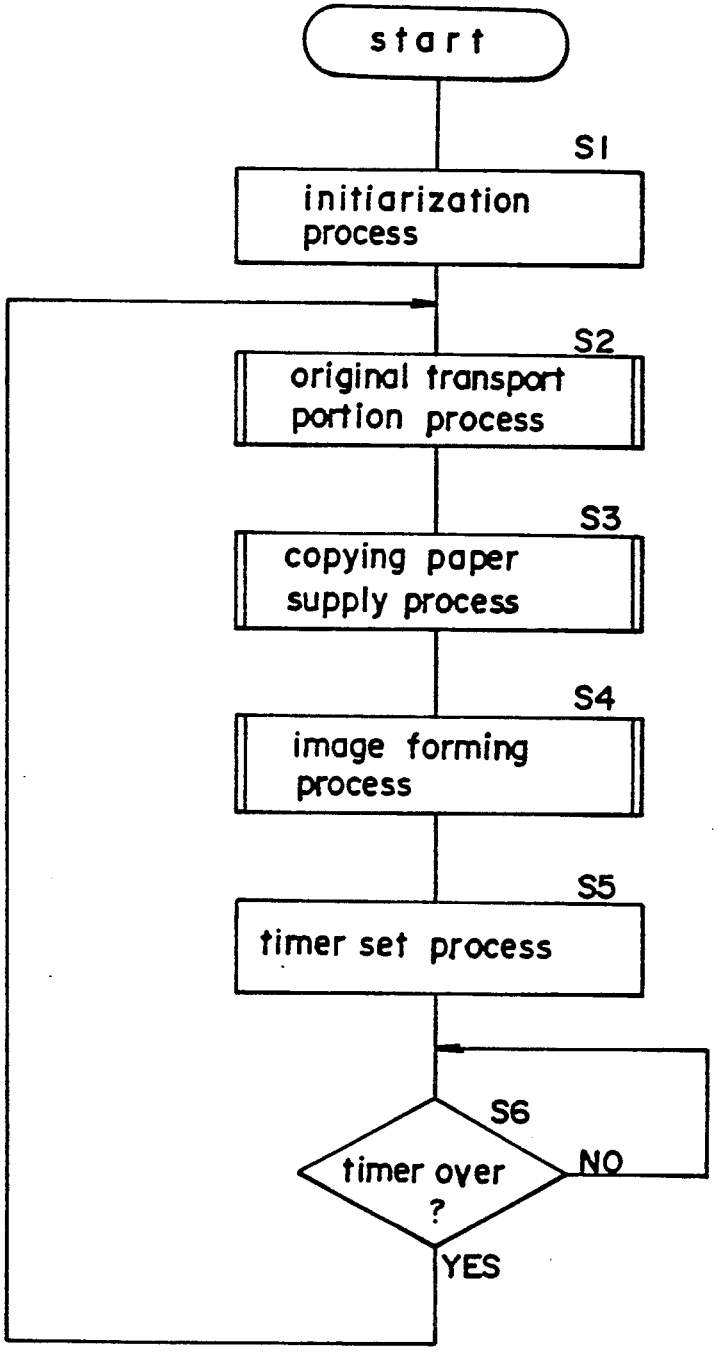
FIG. 3 is a main flow chart of the controls of the copying apparatus incorporating a document handling device.

FIG. 3 shows the main flow of the CPU 301 for controlling the copying apparatus provided with the document feeding device 200.

When the power supply is turned ON to the copying apparatus, the initialization process routine (step S1; hereinafter the term "step" is omitted) is executed to set the various types of copy modes and set the initial modes for the various timers and counters.

Then, the program enters the main routine. First, the original transport portion process routine (S2) is executed to accomplish the transport of an original to discharge of said original via the original transport portion 202.

Next, controls are executed (S3) for the copy paper supply process of the present invention. In this step, copy paper is supplied for the original placed on the platen glass 11 as well as copy paper for an original waiting on the document tray 203.

Thereafter, in the image forming process (S4), an image is formed of the original document image via an electrophotographic process. That is, controls are generally executed from the operation of the optical unit 10, to image exposure, developing, transfer, fixing, and discharge of the copy paper bearing the fixed image.

Then, in the timer setting process (S5), the timer process is executed to set the time period of one-routine. The timer controls and the like of the CPU 501 establish the time period of one-routine as the minimum unit. Thus, when a predetermined time has elapsed (S6: YES), the program returns to S2, and the main routine is repeated.

Figure 4:
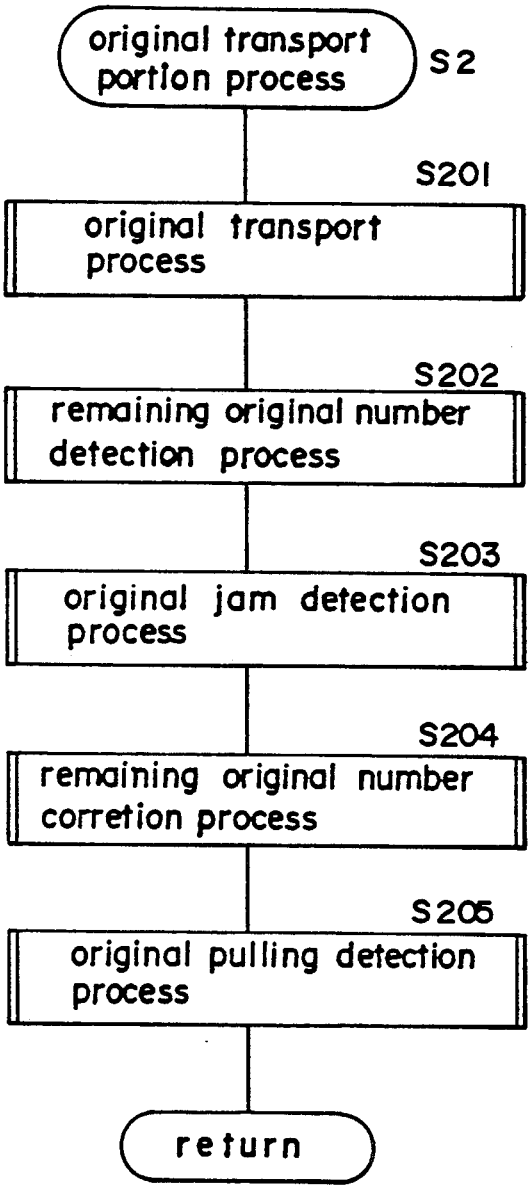
FIG. 4 is a flow chart showing the original transport portion process.

FIG. 4 shows the original transport portion process (S2).

The original transport portion process comprises five routines: original transport process (S201), remaining original number detection process (S202), original jam detection process (S203), remaining original number correction process (S204), and the original pulling detection process (S205). The original transport process (S201) controls the transport operation from the insertion and setting of the original to its discharge. the remaining original number detection process (S202) detects the number of the remaining originals. The original jam detection process (S203) detects jamming of an original. The remaining original number correction process (S204) corrects the number of the remaining originals in accordance with the copy status. The original pulling detection process (S205) detects pulling of an original from the document tray 203.

Figure 5:
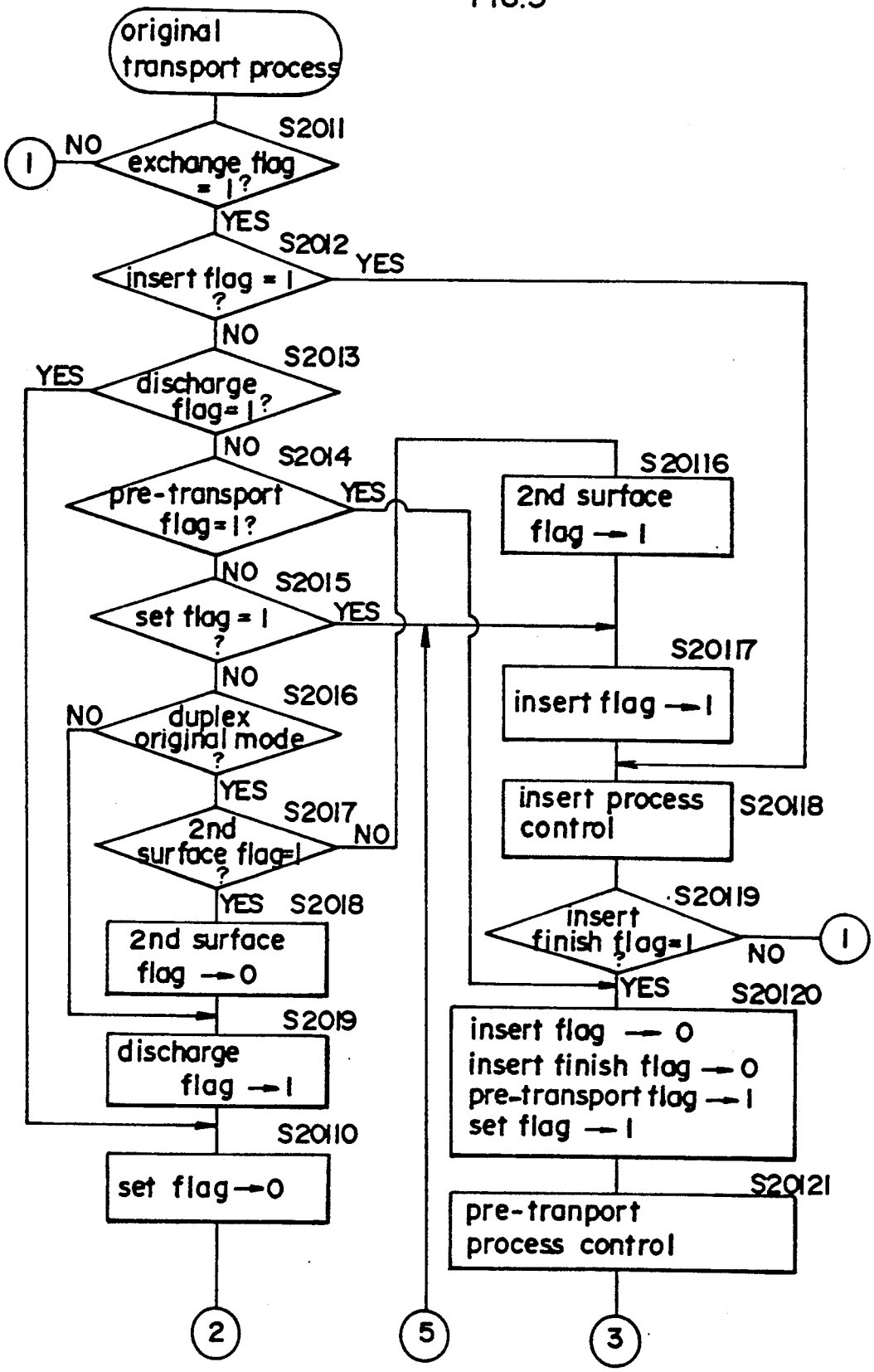
FIG. 5 is a flow chart showing a part of the original transport process.
Figure 6:
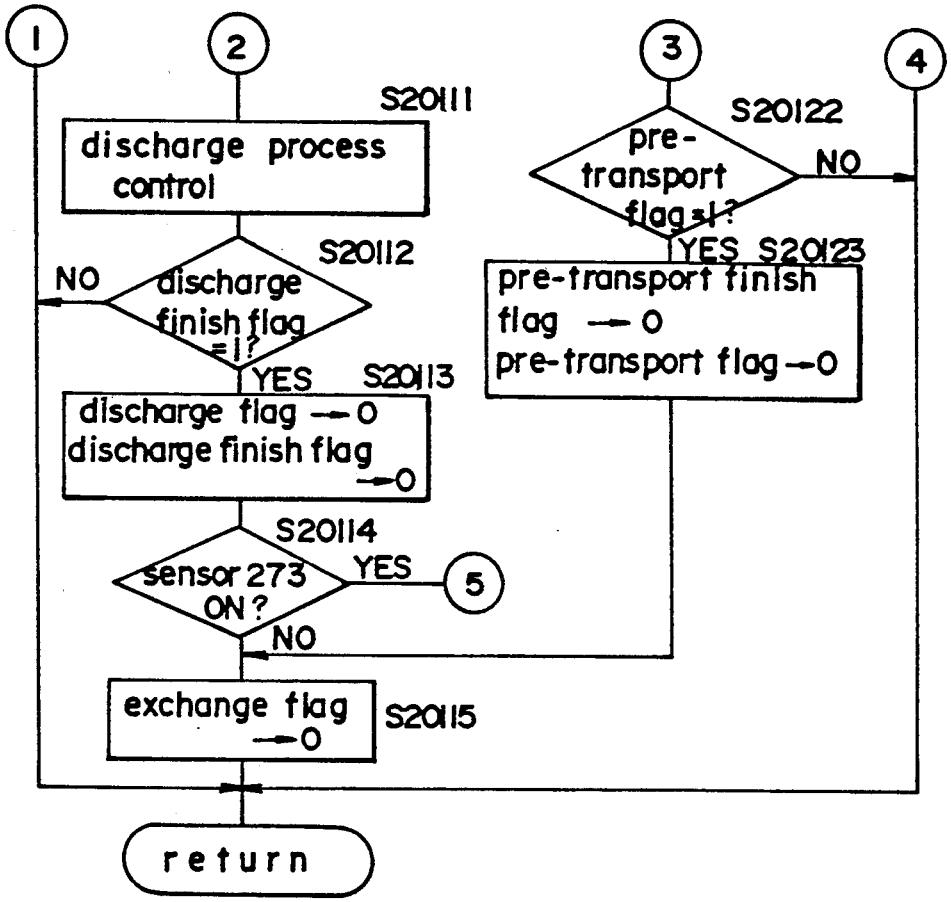
FIG. 6 is a flow chart showing a part of the original transport process.

FIGS. 5 and 6 shows details of the original transport process routine S201).

Figure 28:
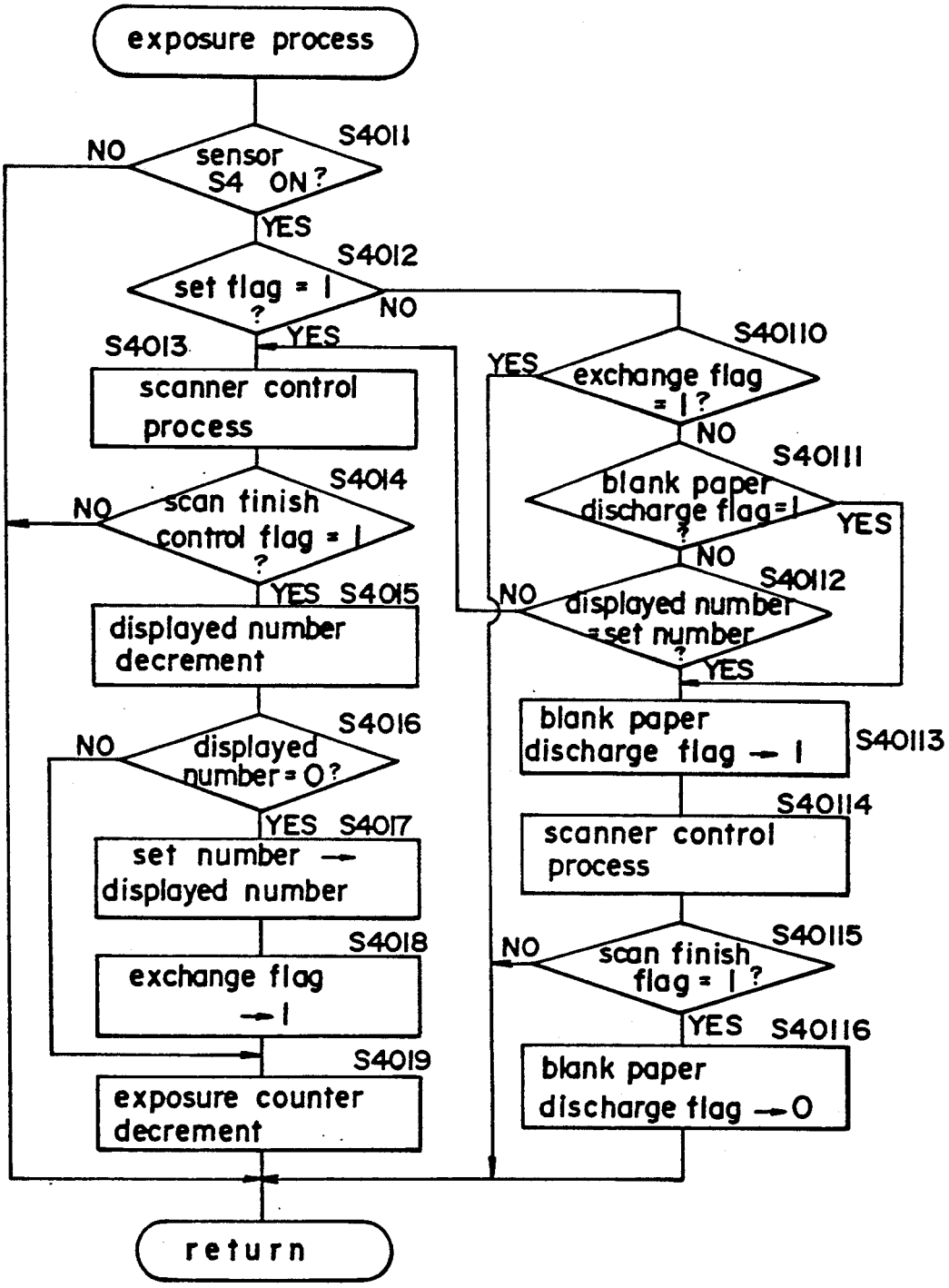
FIG. 28 is a flow chart showing the exposure process.

First, a check is made to determine whether or not the original exchange flag is set (S2011). The original exchange flag is set by depressing the print key or via the timing for the original scan finish (FIG. 28, S4018). When the exchange flag is not set, original transport is not executed and the program returns.

When the exchange flag is set, the insert flag (S2012), discharge flag (S2013) and pre-transport flag (S2014) are then detected. These three flags express the operating state (insert flag, discharge flag, pre-transport flag) of the document feeding device 200.

When the insert flag is set (S2012: YES), the insert process control (S20118) is executed, and operation controls are executed for the motors and the like each time an original document is inserted. When the insert process is finished, and insert finish flag is set within this routine.

Then, a check is made to determine whether or not the insert finish flag is set (S20119). If the insert finish flag is not set, the routine immediately returns.

When the insert process ends and the insert finish flag has been set, the insert flag and the insert finish flag linked to the insert process are reset, and the pre-transport flag and set flag linked to the pre-transport process are reset (S20120). When the aforesaid flags are reset, the document feeding device 200 moves the pre-transport process for the next original (S20121) and executes the pre-transport process for said next original; if the original pre-transport is finished, the original pre-transport finish flag is set.

Then, the routine immediately returns when it is determined that pre-transport finish flag is not set (S20122: NO). When it is determined that the pre-transport finish flag has been set (S20122: YES), the pre-transport flag and pre-transport finish flag are reset (S20123). Thus, the pre-transport process ends, the program advances to S20125, the exchange flag is reset, and the original exchange state is cancelled.

When the discharge flag is found to be set in S2013, the set flag indicating an original is placed on the platen glass 11 is reset (S20110), the discharge process controls are executed (S20111) so as to discharge the original placed on the platen glass 11, and when the discharge of said original is finished, the discharge flag is set.

Then, when a check of the discharge finish flag reveals it is not set (S20112: NO), the routine immediately returns. When a check reveals the discharge finish flag is set (S20112: YES), the discharge flag and the discharge finish flag are reset (S20113), and the discharge process is finished. Next, when it is determined that a detection signal has been transmitted from the sensor 273 (S20114: YES), a check is made to determine whether or not there is a next original, and the routine advances to S20117 to enter the original insert process. When the aforesaid check reveals that a detection signal has not been transmitted form the sensor 273 (S20114: NO), the exchange flag is reset (S20115) and the original exchange state is cancelled.

When any among the insert flag, discharge flag or pre-transport flag has not been set, a check is made to determine whether or not the set flag indicating that an original is placed on the platen glass 11 has been set (S2015). When an original is placed on the platen glass 11, the routine immediately advances to S20117, and the original insert process is executed. If the set flag has not been set, then a check is made to determine whether or not the duplex original mode has been selected (S2016). If the duplex original mode has not been selected, the discharge flag is set to discharge an original (S2019), and the set flag is reset (S20110). If the duplex original mode has been selected, then a check is made to determine whether or not the second surface flag is set (S2017). If the second surface flag is set, it is verified that the second surface of the original is placed on the platen glass 11, the second surface flag is reset (S2018), and the routine advances to S2019 for the discharge process. If the second surface flag is not set, it is verified that the first surface of the original is placed on the platen glass 11, the second surface flag is set (S20116), and thereafter the routine advances to S20117 to place the second surface and the original insert process is entered.

Figure 7:
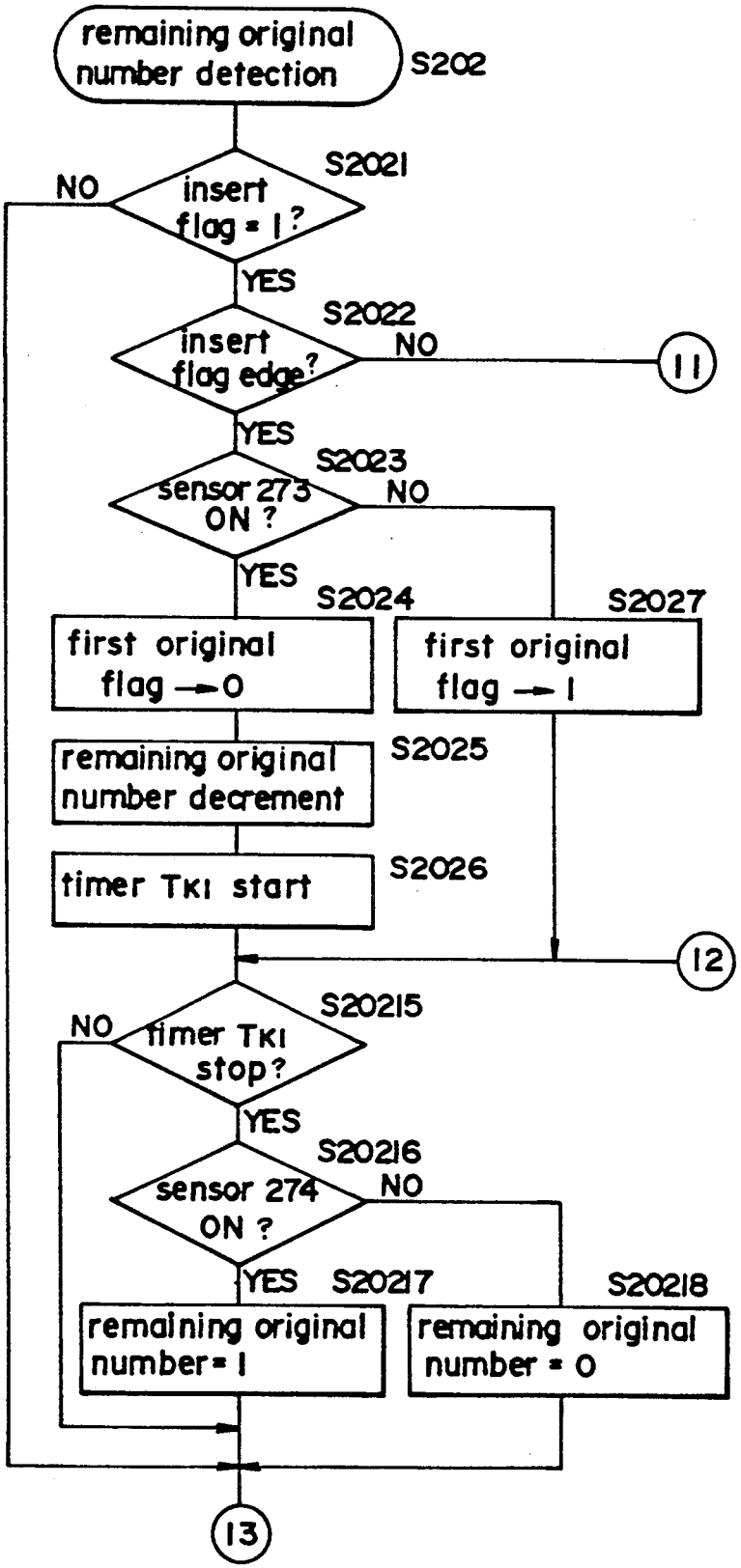
FIG. 7 is a flow chart showing a part of the remaining original number detection process.
Figure 8:
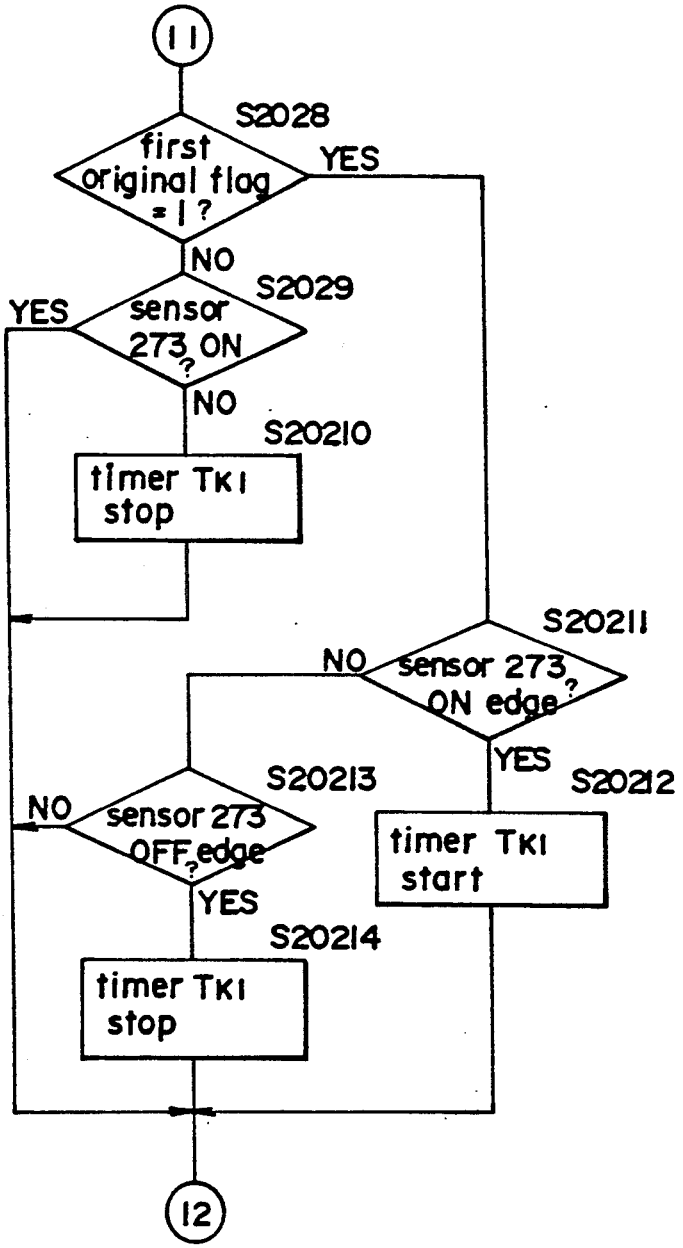
FIG. 8 is a flow chart showing a part of the remaining original number detection process.
Figure 9:
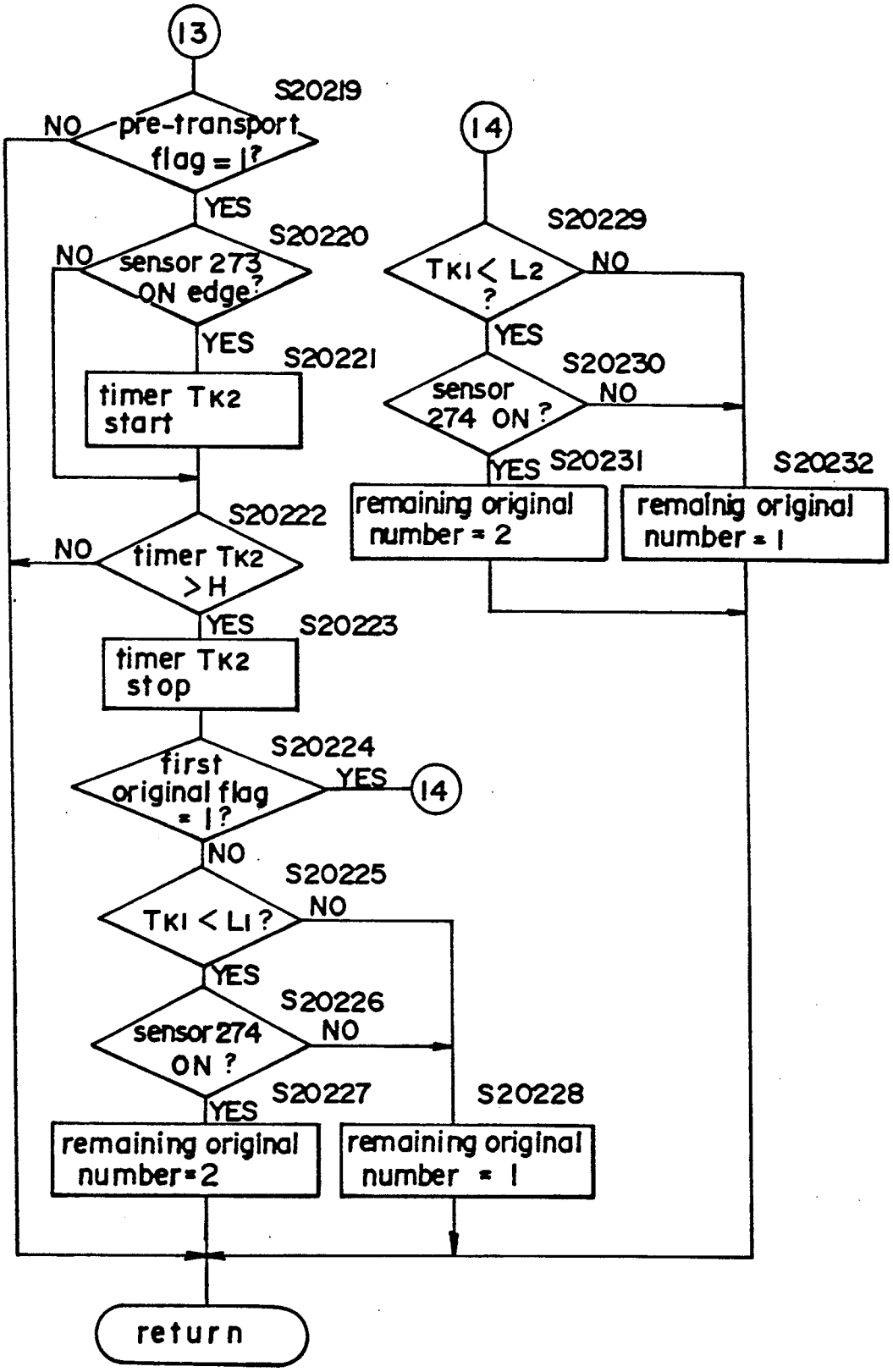
FIG. 9 is a flow chart showing a part of the remaining original number detection process.

FIGS. 7 through 9 show details of the remaining original number detection process (S202).

In the present embodiment, a numeral cannot be entered for the number of the remaining originals placed on the platen glass 11 to include said originals with the originals waiting in the document feeding device 200. That is, when the state of the originals is such that an original only remains on the platen glass 11, the remaining original number is set at zero (0) sheets. When the state of the originals is such that there is a pre-transported original and an original on the platen glass 11 (or there is only a pre-transported original), the remaining original number is set at one (1) sheet. When the state of the originals is such that there is an original on the platen glass 11 and a pre-transported original and an original in the document tray, the remaining original number is set at two (2) sheets.

First, a check is made to determine whether or not the insert flag is set indicating an original document is being inserted (S2021). If an original is not being inserted, the routine immediately advances to S20219.

If the insert flag is set, a check is then made to determine the edge state of the insert flag. When the original insertion starts (S2022: YES) and the sensor 273 does not detect an original (S2023: NO), the first original is not pre-transported, the first original flag set when the first original is inserted is set (S2027), and the routine advances to S20215. When a second original is inserted, the sensor 273 detects a pre-transported original (S2023: YES). At this time, the first original flag is reset because the detected original is not the first original (S2024), the second original is decremented form the remaining original number of that portion of the insert process (S2025), and the timer TK1 is started (S2026), whereupon the routine advances to S20215.

The aforesaid timer TK1 clocks the time period from the timing of the start of the process for original insertion until the trailing end of the original passes the sensor 273. That is, the size of the original is detects. Thereafter, in S20229 through S20232, the size of the original is determined, i.e., the original size is A3 when TK1>L2; the original size is A4 when TK1<L2. In S20225 through S20228, the size of the original is determined, i.e., the original size is A3 when TK1>L1; the original size is A4 when TK1<L1.

If the original insert timing is not set in S2022, the routine immediately continues to S2028. If it is not the first original (S2028: NO), the output of the sensor 273 is monitored (S2029), and if there is current output the routine advances to S20215. When the trailing end of the second original passes the sensor 273, the sensor 273 does not detect the original and the timer TK1 stops (S20210), and the routine continues to S20215. If the first original has already been inserted (S2028: YES) and the leading end of said first original passes the sensor 273 (S20211: YES), the timer TK1 is started and the routine continues to S20215. When the trailing end of the first original passes the sensor 273, the output of said sensor 273 stops (S20213: YES), the timer TK1 stops (S20214), and the routine continues to S20215.

When the timer TK1 stops (S20215: YES), a check is made to determine whether or not there is an original present on the document tray 203 via the sensor 274 (S20216). If an original is present on the document tray 203, the remaining original number is set at 1 (S20217), whereas if an original is not present (S20216: NO), the remaining original number is set at 0 (S20218), and the routine continues to S20219.

When the pre-transport flag is set (S20219: YES) and the leading end of the pre-transported original passes the sensor 274 (S20220: YES), the timer TK2 is started (S20221). When the counter TK2 exceeds a predetermined count H (S20222: YES), the timer TK2 is stopped.

When the count H is exceeded, the original on the document tray has been transported from said tray and has arrived at the pre-transport position. At this moment, the presence of a third original on the document tray is first detectable. That is, in the case of an A4-size horizontal-feed original, the second original is detected by the sensor 273, but is not detected by the sensor 274. When the reply to the query in S20225 or S20229 is YES (A4 size), if the sensor 274 detects an original, an original is present on the document tray such that the remaining original number is set at 2 for the pre-transported original and the original on the document tray 203. When the sensor 274 does not detect an original, an original is not present on the document tray 203 and the remaining original number is set at 1.

In the case of A3-size vertical-feed originals, a pre-transported original is detected by both the sensors 273 and 274. When the reply to the query in S20225 or S20229 is NO (A3 size), the remaining original number is set at 1 (one sheet only) for the pre-transported original since another original has not been detected on the document tray.

When the original is not a first original (S20224: NO) and the size of the original is smaller than the predetermined count L1 (S20225: YES), if the sensor 274 detects the original (S20226: YES), the remaining original number is set at 2 (S20227); whereas if the sensor 274 does not detect an original (S20226: NO), the remaining original number is set at 1 (S20228). Furthermore, if the size of the original is larger than L1 (S20225: NO), the remaining original number is set at 1 (S20228). At this time, the timer TK1 counts the time period from the start of the insert process to the trailing end of the original passes the sensor 273, and the count value L1 is set so as to allow discrimination of A3 size and A4 size paper.

If the original is a first original and the size of said original is smaller than a predetermined count L2 (S20229: YES), i.e., if the original is detected by the sensor 274 (S20230: YES), the remaining original number is set at 2 (S20231), whereas in other cases the remaining original number is set at 1 (S20232). At this time, the timer TK1 counts the time period from the point at which the leading end of the original passes the sensor 273 until the trailing end of the original passes said sensor 273, and the count value L2 is set so as to allow discrimination of A3 size and A4 size paper.

The remaining original number is set in the aforesaid manner, and the routine returns.

Figure 10:
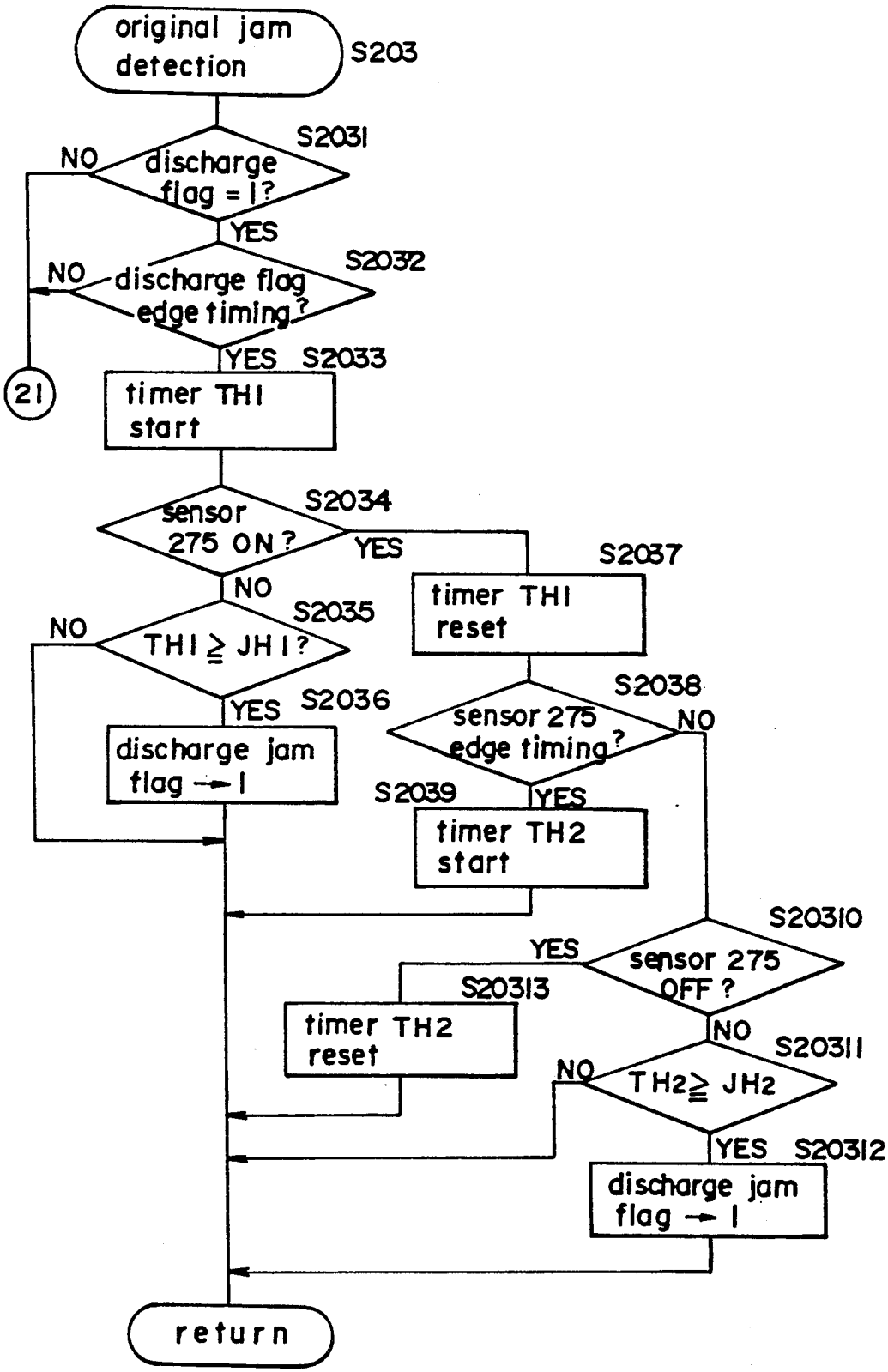
FIG. 10 is a flow chart showing a part of the original jam detection process.
Figure 11:
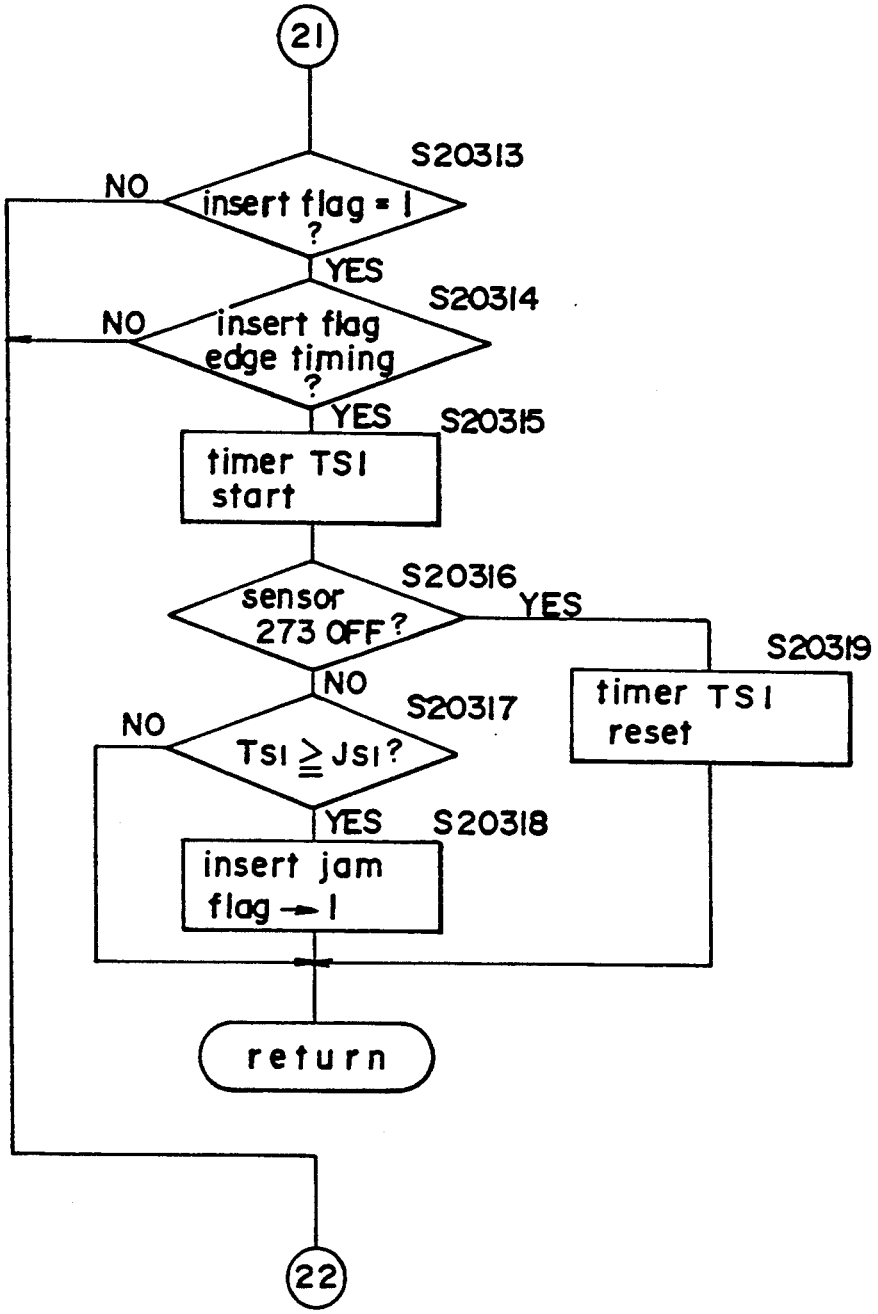
FIG. 11 is a flow chart showing a part of the original jam detection process.
Figure 12:
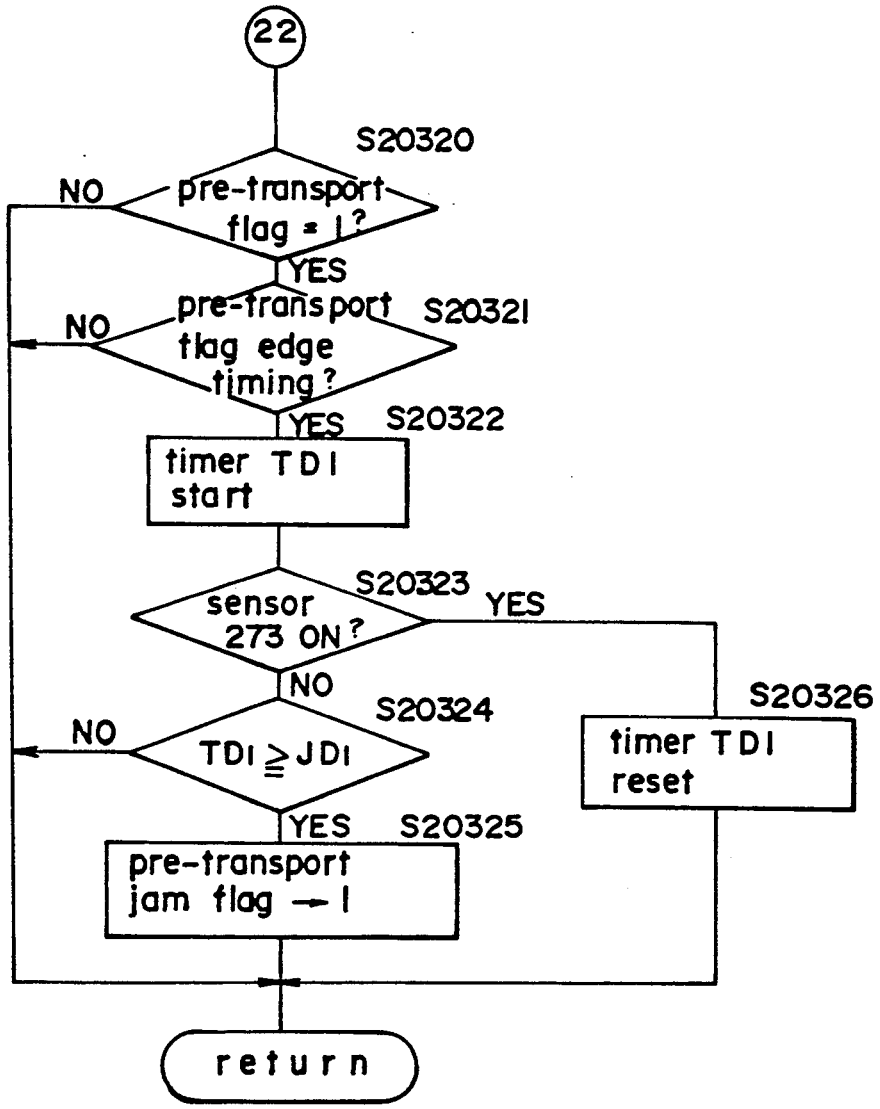
FIG. 12 is a flow chart a part of the original jam detection process.

FIGS. 10 through 12 show details of the original jam detection process for detecting jammed originals (S203). First, a check is made to determine whether or not the discharge flag is set (S2031). If the discharge flag is set, the discharge flag edge timing (discharge start time) is then checked (S2032). Thus, when a movement to the original discharge state is not detected (S2031, S2032: NO), the routine immediately advances to S20313, and enters the insert jam detection.

When a move to the original discharge state is detected, the discharge jam detection timer TH1 is first started (S2033) and the signal output by the sensor 275 are monitored to detect discharge jams. When the sensor 275 does not output original detection signals (S2034: NO), a check is made to determine whether or not the timer TH1 value is greater than a predetermined count JH1 (S2035). If the sensor 275 does not detect an original by the time the timer TH1 has counted JH1 (S2035: YES), it is determined that the discharging original has not been transported to the sensor 275, the discharge jam flag is set (S2036), and the routine returns.

On the other hand, when the sensor 275 does output a detection signal (S2034: YES), it is determined that the original has been normally transported and the timer TH1 is reset (S2037). When the sensor 275 original detection time (edge timing) is set (S2038: YES), the timer TH2 is started (S2039), and the routine returns. When the sensor 275 detection signal edge timing is not set (S2038: NO), it is determined that the sensor 275 has not detected an original (S20310: YES) and, therefore, the original has been discharged, the timer TH2 is reset (S20313), and the routine returns. When the timer TH2 has not exceeded a predetermined count JH2 (S20310: NO), the routine returns even if the sensor 275 has detected an original. However, when the timer TH2 exceeds the count JH2 (S20311: YES), it is determined that the original has not discharged and the discharge jam flag is set (S20312), whereupon the routine returns.

In the insert jam detection, first a check is made to determined whether or not the insert flag is set (S20313). If the insert flag is set, the insert flag edge timing (set timing) is checked (S20314). Thus, when a move to the original insert state is not detected (S20313, S20314: NO), the routine immediately advances to S20320 to enter the pre-transport jam detection.

When a move to the original insert state is detected, the timer TS1 is started (S20315), and the signals output by the sensor 273 are monitored. When signal output from the sensor 273 is not detected (S20316: YES), it is determined that the original has been properly inserted, the timer TS1 is reset (S20319), and the routine returns. When the timer TS1 counts a predetermined count JS1 (S20317: YES) and the sensor 273 output signals are detected, an insert jam is determined, the insert jam flag is set (S20318) and the routine returns.

In the pre-transport jam detection, a check is first made to determine whether or not the pre-transport flag is set (S20320). If the pre-transport flag is set, the pre-transport flag edge timing (set timing) is checked (S20321). Thus, when a move to the original pre-transport state is not detected (S20320, S20321: NO), the routine immediately returns.

When a move to the original pre-transport state is detected, the timer TD1 is started (S20322), and the signal output of the sensor 273 is monitored. When the sensor 273 has detected an original (S20232: YES), the pre-transport of said original is determined to have been normal, the timer TD1 is reset (S20326), and the routine returns. When the sensor 273 does not detect an original and the timer TD1 reaches a predetermined count JD1 (S20324: YES), a pre-transport jam is determined, the pre-transport jam flag is set (S20325), and the routine returns.

Figure 13:
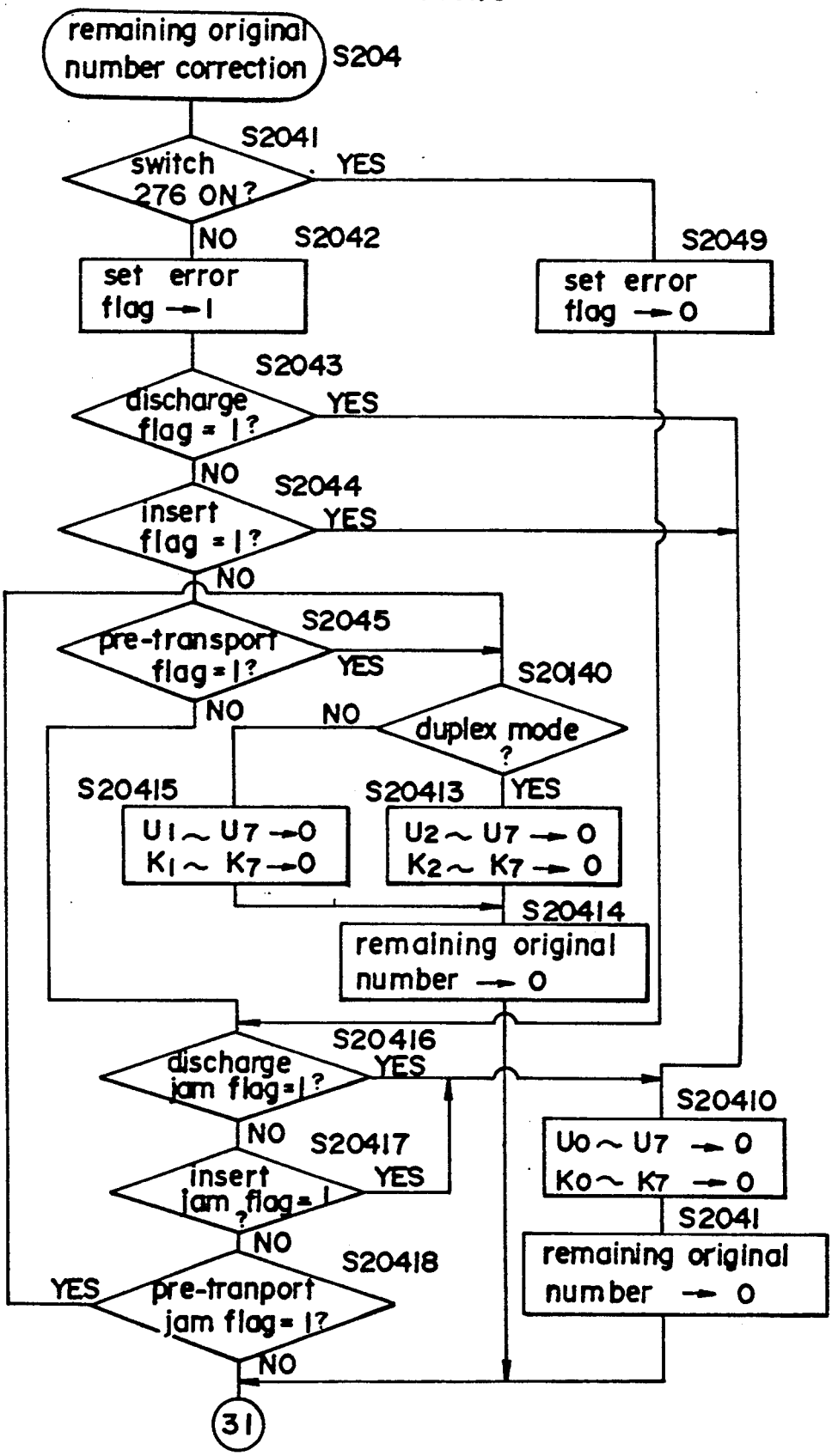
FIG. 13 is a flow chart showing a part of the remaining original number correction process.
Figure 14:
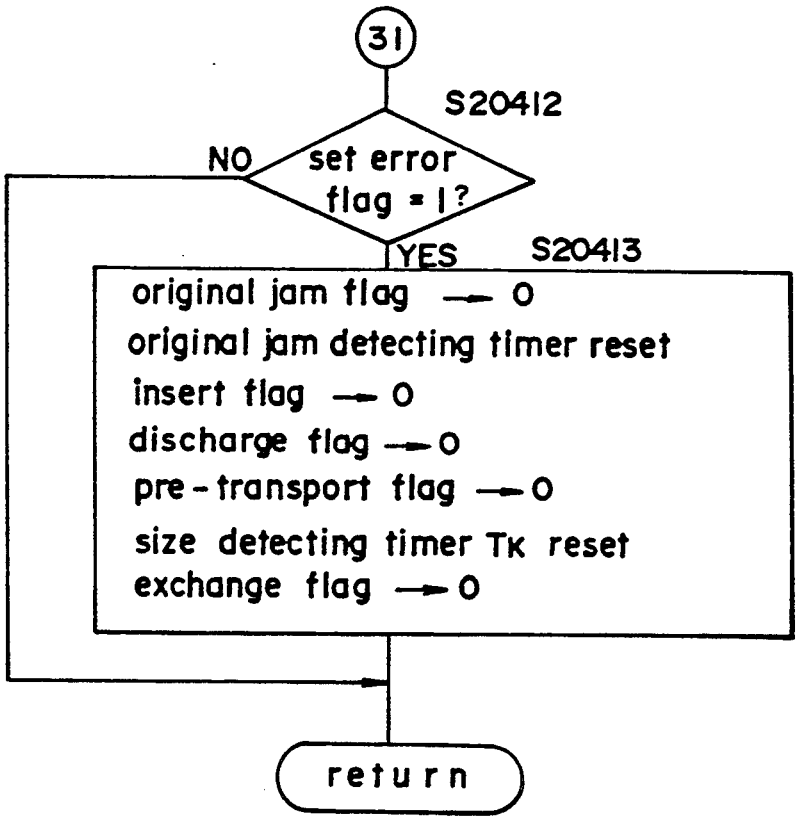
FIG. 14 is a flow chart showing a part of the remaining original number correction process.

FIGS. 13 and 14 show details of the remaining original number correction process (S204). In this process, in the case of a set error of the ADF 200 during original insert (S2041: NO; S2044: YES), set error of the ADF 200 during original discharge (S2041: NO; S2043: YES), insert jam (S2041: YES; S2047: YES), and discharge jam (S2041: YES; S2046: YES), the original document information ($U_0 \sim U_7$, $K_0 \sim K_7$) for all originals (originals on document tray, pre-transported originals, originals on platen glass) is reset, an the copy paper supply operation for all originals is terminated in the subsequent paper supply information deletion process (S303).

On the other hand, in the case of a set error of the ADF 200 during pre-transport of an original (S2041: NO; S2045: YES), and pre-transport jam (S2041: YES; S2048: YES), the original on the platen glass 11 can be copied so that therefore the original information $U_0K_0$ (single side mode) or $U_0U_1K_0K_1$ (duplex mode) for the original on the platen glass 11 is maintained, whereas all other original information, i.e., $U_1 \sim U_7$, $K_1 \sim K_7$ (single side mode) or $U_2 \sim U_7$, $K_2 \sim K_7$ duplex mode) is reset. Thus, copy paper supply operation is permitted only for the original disposed on the platen glass 11, and copy paper supply operation for all other originals is prohibited.

First, a check is made to determine whether or not a signal has been input from the set switch 276 (S2041). If a signal has not been input from the set switch 276, there are no originals placed on the ADF 200 and, therefore, the set error flag is set (S2042). Next, the state of the original is confirmed. When the discharge flag is set indicating an original is being discharged (S2043: YES), and when the insert flag is set indicating an original is being inserted (S2044: YES), the paper supply information, i.e., flags $U_0 \sim U_7$ and $K_0 \sim K_7$ are reset (S20410), then the remaining original number is switched to the copy enable number (=0) (S20411). Thereafter, the routine advances to S20412.

If the original pre-transport is currently on-going (S2045: NO), an original jam is detected. That is, when the discharge jam flag is set indicating a discharge jam (S2046: YES) and when the insert jam flag is set indicating an insert jam (S2047: YES), the routine continues to S20410 where the paper supply information, i.e., flags $U_0 \sim U_7$ and $K_0 \sim K_7$, is reset (S20410), and the remaining original number is switched to the copy enable number (=0) (S20411). Then, the routine advances to S20412. When the pre-transport jam flag is set indicating a pre-transport jam (S2048: YES), the routine continues to S20412, the paper supply information excluding the supply information for the original on the platen glass 11 is reset, and the remaining original number is switched to the copy enable number. If the original jam state does not obtain (S2048: NO), the routine continues to S20412.

After the aforesaid processes are finished, a check is made to determine whether or not the set error flag is set indicating the occurrence of a set error of the ADF 200 (S20412). If a set error occurs, the various types of flags and timers (original jam flag, insert flag, discharge flag, pre-transport flag, exchange flag, original jam detection timer, size detection timers and the like) are reset (S20413).

Figure 15:
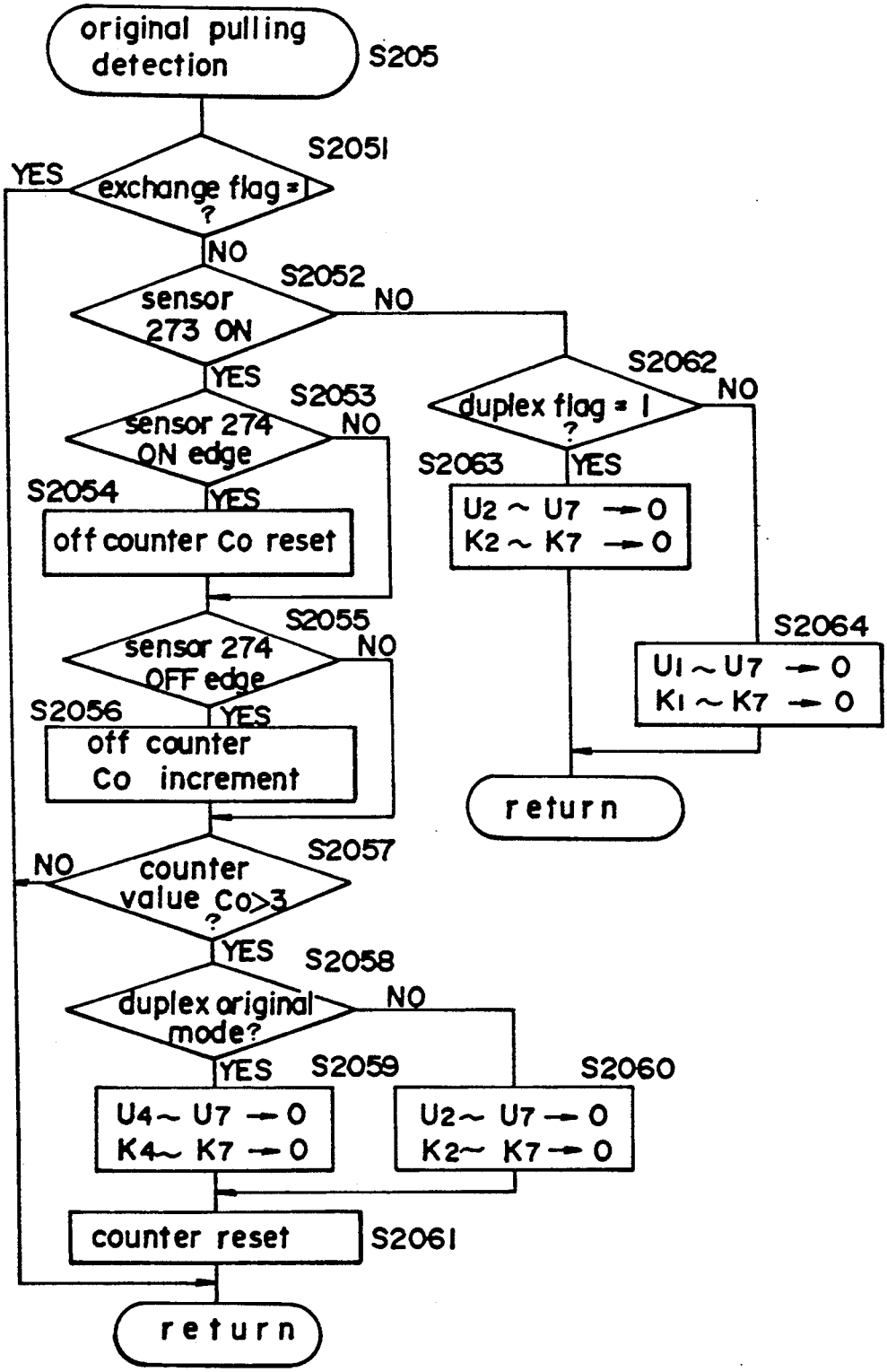
FIG. 15 is a flow chart showing the original pulling detection process.

FIG. 15 shows details of the original pulling detection process (S205). First, checks are made to determine whether or not the print key has been depressed or the exchange flag set by the scan end timing has been set (S2051). If said exchange flag is set (original exchange state), the routine immediately returns.

When the exchange flag has not been set (S2051: NO), a check is made to determine whether or not the sensor 273 detects an original (S2052). When the sensor 273 detects an original, i.e., when a second original is present, the output of the sensor 274 on the document tray 203 is monitored. When the sensor 274 output is ON-edge (i.e., timing wherein an original is not detected) (S2053: YES), the OFF counter $C_O$ is reset (S2054). Then, when the output of the sensor 274 is OFF-edge (S2055: YES), the OFF counter $C_0$ is incremented (S2056), and the frequency with which the signals of the sensor 274 are not detected is totaled. When the aforesaid total value is greater than 3 (S2057: YES), the paper supply information for the third original is reset, and the paper supply is prohibited. That is, when the duplex mode is selected (S2058: YES), the flags $U_4 \sim U_7$ and $K_4 \sim K_7$ are reset (S2059), whereas when the duplex mode is not selected (S2058: NO), the flags $U_2 \sim U_7$ and $K_2 \sim K_7$ are reset (S2060). The aforesaid process is executed to avoid an error by the sensor 274 since there is a danger that the sensor 274 may erroneously detect the presence or absence of an original when the normal output of the sensor 274 is not output, e.g., in the case of switching OFF→ON→OFF→ON. The sensor 274 may produce an error due to noise, detection state caused by curvature of an original or the like, and adverse detection environment. Then, the counter $C_0$ is reset (S2061) and the routine returns.

According to the above described process, when a third original is pulled from the document tray 203, the copy paper supply operation is stopped for said third original, and after the detection results of the sensor 274 are calculated a predetermined number of times (three times in the present embodiment), erroneous discrimination by the sensor is avoided because the absence of the original can be detected. Furthermore, the discrimination of the presence and absence of an original via the sensor 274 can decrease the possibility of erroneous discrimination because said discrimination is also executed during the period for supplying the copy paper after the presence of an original has been detected.

When the sensor 273 does not detect an original in S2057, the paper supply information is reset for the second original, and the copy paper supply is prohibited. That is, when the duplex original mode is selected (S2058: YES), the flags $U_2 \sim U_7$ and $K_2 \sim K_7$ are reset (S2059), whereas when the duplex original mode is not selected (S2058: NO), the flags $U_1 \sim U_7$ and $K_1 \sim K_7$ are reset (S2055), and the routine returns.

Figure 16:
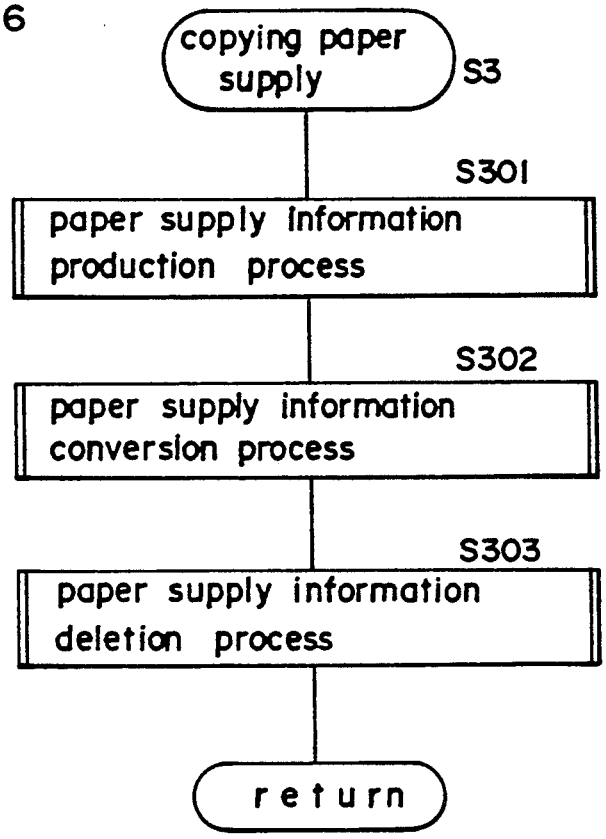
FIG. 16 is a flow chart showing the copy paper supply process.
Figure 17:
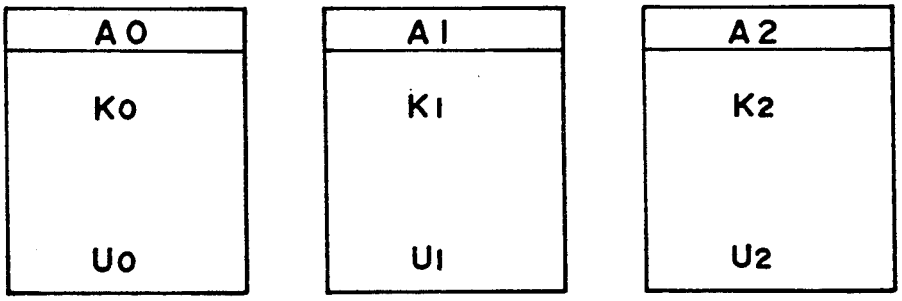
FIG. 17 shows an example of the paper supply information.

FIG. 16 shows copy paper supply process (S3). The copy paper supply process comprises three routines: the paper supply information production process (S301) for producing paper supply information, paper supply information conversion process (S302), and the paper supply information deletion process (S303) which are described below.

First, the creation of copy paper supply information is described with reference to FIGS. 17 and 18. Copy paper supply information creates one area per one surface of an original. Original areas are created for waiting originals, including an original placed on the platen glass 11.

In the case of the one-side original mode, as shown in FIGS. 17, the address (A0) is the area corresponding to the original on the platen glass 11, address (A1) is the area corresponding to the next original to be transported to the platen glass 11, and the address (A2) is the area corresponding to the last verified original.

Figure 18:
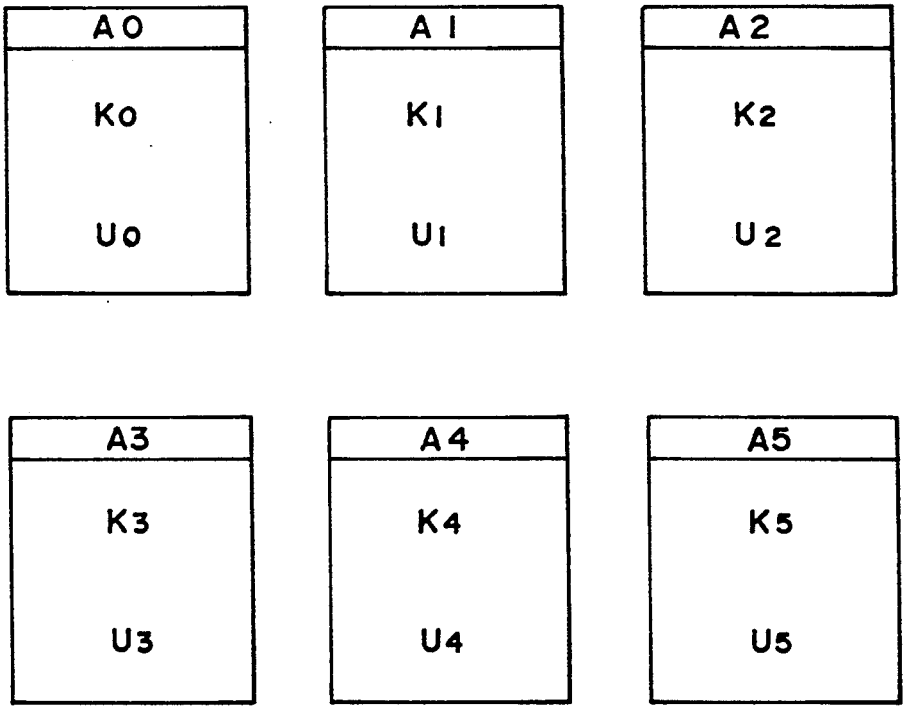
FIG. 18 shows an example of the paper supply information for duplex copying.

In the case of the duplex original mode, as shown in FIG. 18, the addresses (A0) and (A1) are the areas corresponding to the original on the platen glass 11, addresses (A2) and (A3) are areas corresponding to the next original to be transported to the platen glass 11, and the addresses (A4) and (A5) are areas corresponding to the next original on the document tray 203. Two information elements are produced for the same original, and the smallest address numbers correspond to the surface of the original set initially.

In the aforesaid areas of original information are stored the bit (K) expressing incomplete/complete paper supply for the original relative to said area, and bit (U) expressing the validity/nullity of said area.

Figure 19:
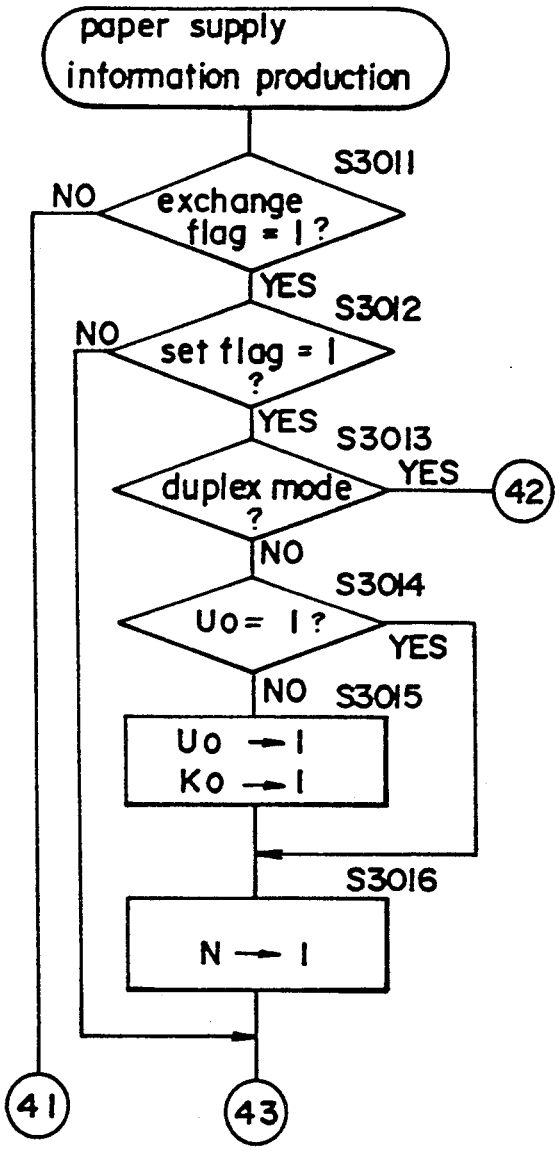
FIG. 19 is a flow chart showing a part of the paper supply information production process.
Figure 20:
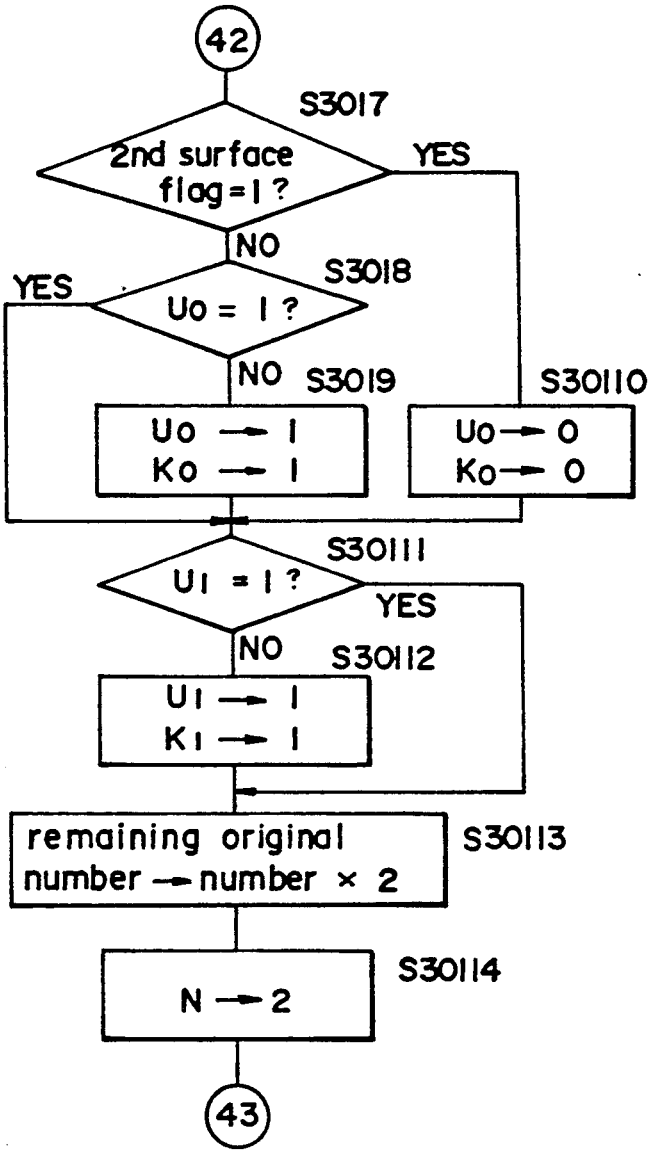
FIG. 20 is a flow chart showing a part of the paper supply information production process.

FIGS. 19~21 show details of the paper supply information production process (S301). First, a check is made to determine whether or not the exchange flag is set indicating an original exchange is currently on-going (S3011). If an original exchange is not currently on-going (S3011: NO), the routine immediately returns. If an original exchange is currently on-going, a check is made to determine whether or not the set flag is set indicating an original is placed on the platen glass 11 (S3012). If the set flag is not set, the routine advances to S30115. If the set flag is set, the paper supply information is produced for the original on the platen glass 11. First, in the case of one-sided originals (S3013: NO), when there is valid information ($U_0=1$) corresponding to the original on the platen glass 11, i.e., when a first original is inserted and pre-transporting is started, the paper supply incomplete flag $K_0$ and the valid flag $U_0$ for the original on the platen glass 11 are set (S3015). Then, N is set at 1 (S3016). Thereafter, the routine continues to S30115 because the information production is completed for the original on the platen glass 11.

On the other hand, in the case of the duplex original mode (S3013: YES), the second surface flag is checked to determine whether or not the currently set surface is the first surface or the second surface (S3017). If the second surface flag is set, the information for the first surface is nullified because the second surface of the original is set (S30110). However, when the second surface flag is not set, the paper supply incomplete flag ($U_0$) and the valid flag ($K_0$) are set for the original on the platen glass 11 (S3019) only when the first surface information is valid ($U_0=0$) (S3018: NO), i.e., when the first original is inserted and pre-transport has started, because the first surface of the original is set. Then, the paper supply incomplete flag ($U_1$) and the valid flag ($K_1$) are set (S3019) only when the second surface information is valid ($U_1=0$) (S30111: NO). Then double the remaining original number (i.e., the number of surfaces) is set as the remaining number (S30113), and N is set at 2 (S30114). Thus, the information production relative to the original on the platen glass is finished and the routine continues to S30115.

Then, information is produced for the portion of the originals waiting on the document tray 203 of the ADF 200. First, a check is made to determine if the remaining surface number is 0 (S30115). If the remaining surface number is 0 the routine immediately returns. If the remaining surface number is not 0, the paper supply incomplete flag ($U_N$) and the valid flag ($K_N$) are set (S30117) only when said surface is valid ($U_N=0$) (S30116: NO). If the paper supply incomplete flag $K_{N-1}$ is not set (S30118: NO), the paper supply flag F1 is set at 1 (S30119). Then, N is incremented (S30117), and when the remaining surface number is not greater than N (S30119: YES), the routine returns to S30116 and the original information production continues. For example, in the one-side mode, when the presence of a pre-transported original is confirmed (remaining number=1) (S30115), the pre-transported original (valid) flag is set $U_1=1$, the paper supply incomplete flag is set $K_1=1$, and the routine returns. When the remaining number is 2 in the one-side mode, and after the original information ($U_1$, $K_1$) is produced for the same pre-transported original, the original information ($U_2$, $K_2$) for the original on the document tray 203, and the routine returns. The process is identical for the duplex mode.

Figure 22:
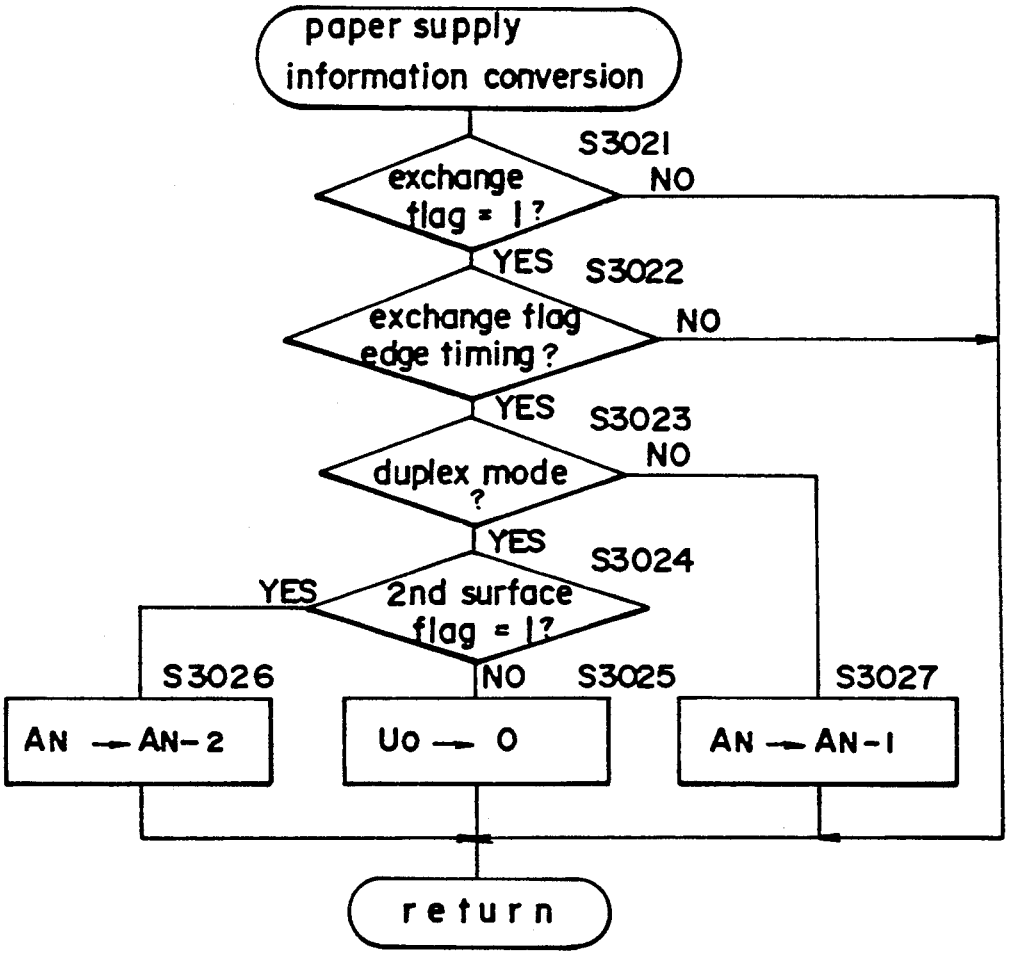
FIG. 22 is a flow chart showing the paper supply information conversion process.

FIG. 22 shows details for the paper supply information conversion process (S302). In this process, the information is deleted which relates to the original discharged during the original exchange. The information for the original newly set on the platen glass 11, information for the original newly pre-transported, and the information for the original newly verified are updated at predetermined addresses in this process.

First, the exchange flag and the exchange flag edge timing are checked, and if it is determined that the original exchange timing is not set (either S3021 or S3022: NO), the routine immediately returns. If the original exchange timing is set, then a check is made to determine whether or not the duplex mode is selected (S3023). If the one-side mode is selected (S3023: NO), the paper supply information is moved to the next smaller address (S3027), and the routine returns. At this time, the information at address (A0) is simultaneously deleted because there is no corresponding original. If the duplex mode is selected (S3023: YES), the information ($U_0$) for the first surface of the original is deleted (S3025) when the second surface flag is not set (S3024: NO). When the second surface flag is set (S3024: YES), the information for one original sheet is moved to the second smaller address (S3026).

Figure 23:
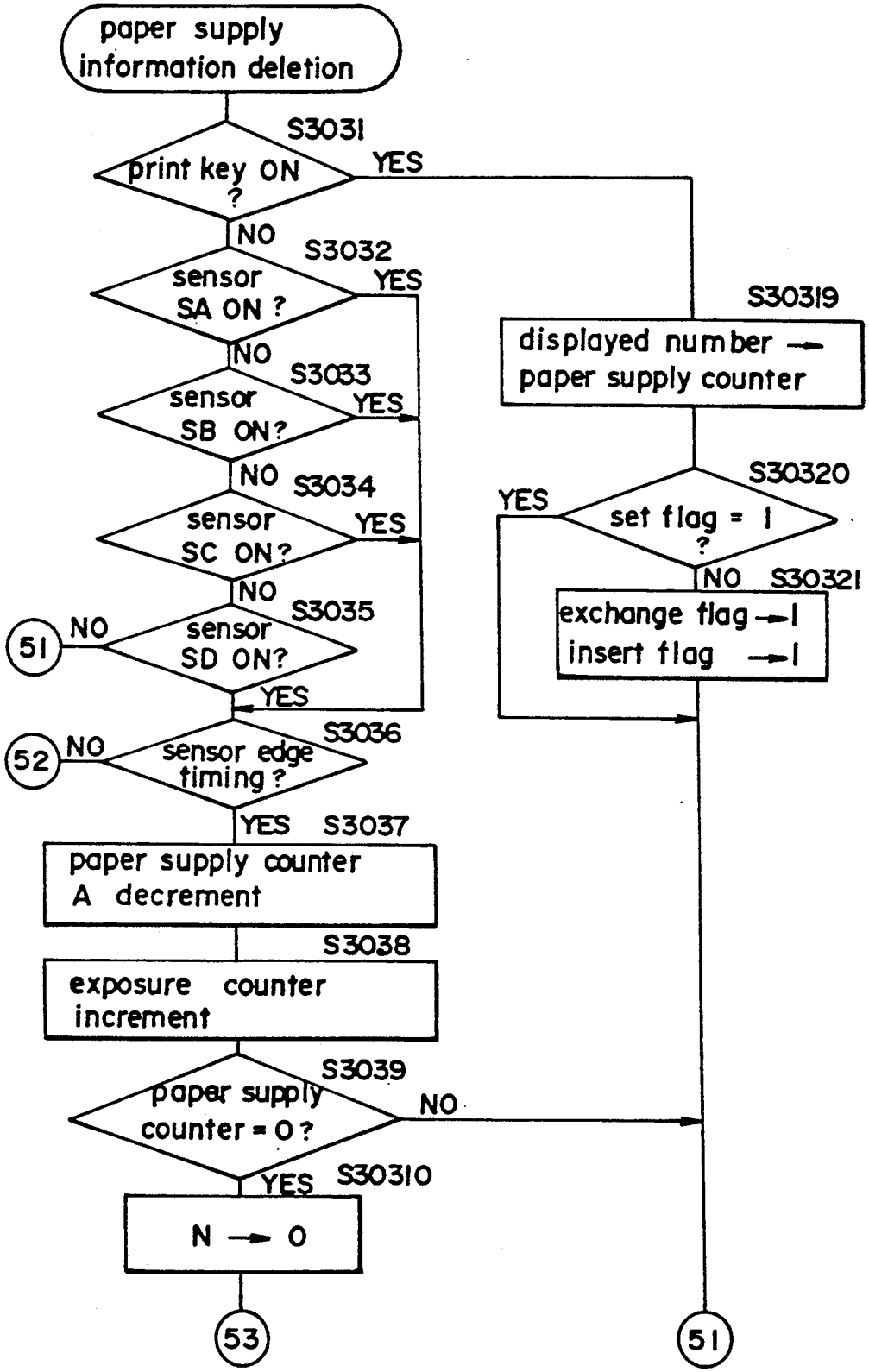
FIG. 23 is a flow chart showing a part of the paper supply deletion process.
Figure 24:
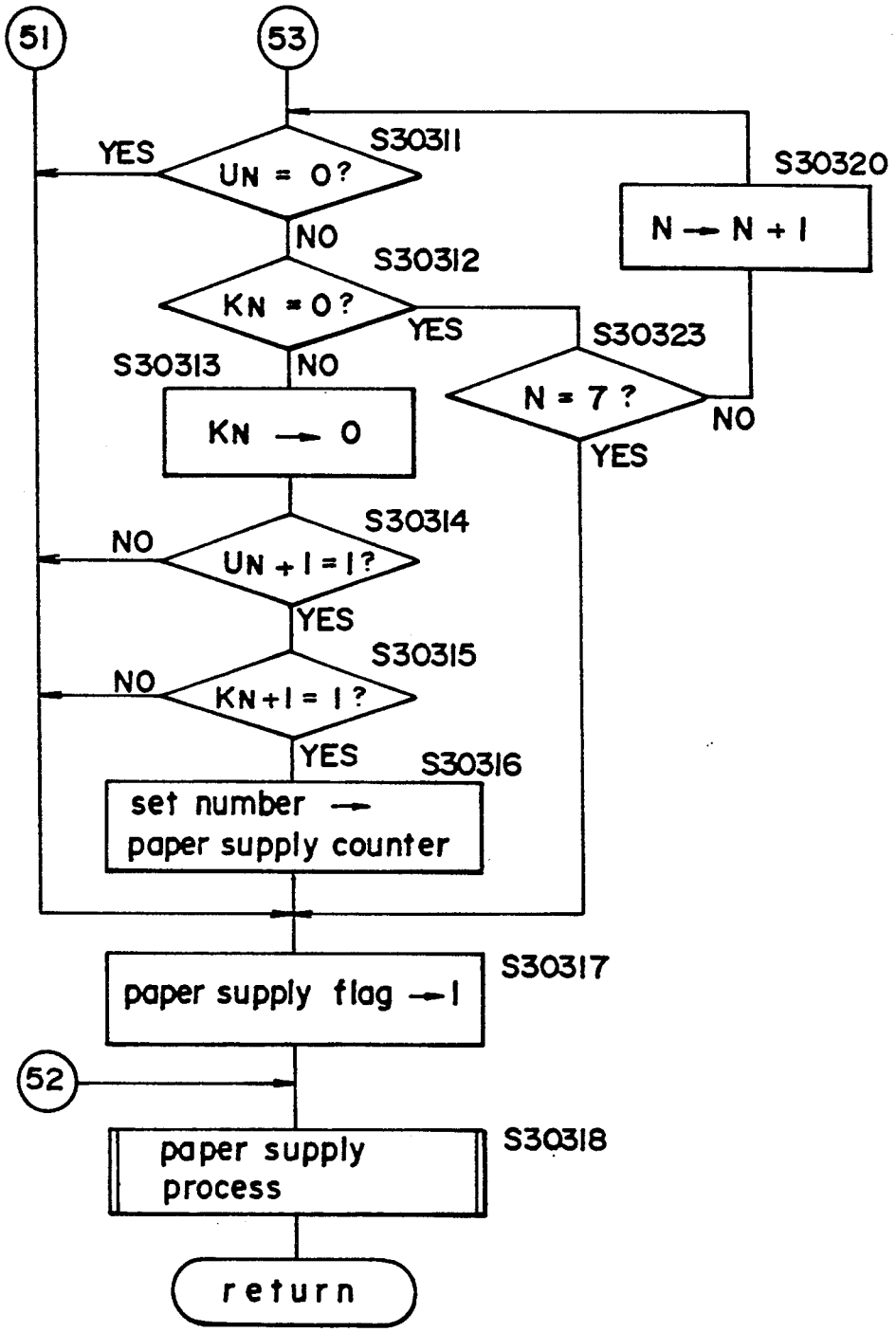
FIG. 24 is a flow chart showing a part of the paper supply deletion process.

FIGS. 23 and 24 show details of the paper supply information deletion process (S303). When depression of the print key on the operation panel (not illustrated) is not detected (S3031: NO), and if feeding of the copy paper is detected by any of the sensors SA, SB, SC or SD (S3032, S3033, S3034, S3035: YES), i.e., if the output edge timing is determined for said sensor (S3036: YES), the paper supply counter is incremented (S3037) and the exposure counter is incremented (S3038) because the paper supply has started.

If the paper supply counter registers 0 (S3039: YES), it is determined that the multicopying is finished, and the copy paper supply operation for the next original is entered. First, the referred paper supply information at address N is set at 0 (S30310), and determinations are made sequentially as to whether or not the copy paper supply operations are completed ($K_N=0$) for the original on the platen glass 11, the original pre-transported, and the original on the document tray. That is, first it is determined whether or not there is valid paper supply information (S30311). If there is valid information ($U_N=1$), the paper supply incomplete flag $K_N$ is checked (S30312). If the paper supply is finished ($K_N=0$) (S30312: YES) but N has not exceeded 7 (S30323: NO), N is incremented (S30324), and the next referred paper supply information address is set, then the routine returns to S30311.

If, on the other hand, the paper supply is not finished ($K_N=1$) (S30312: NO), the paper supply information $K_N$ is deleted (S30313) For example when the paper supply is not completed for a pre-transported original ($K_1=1$), the paper supply counter is set at 0 to indicate the completion of the paper supply operation for the set copy number relating to the pre-transported originals, such that $K_1=0$ is set to complete the paper supply operation relating to the pre-transported originals. Then, a check is made to confirm the presence of a next original for which copy paper has not yet been supplied (S30314, S30315). When a next original is waiting after the original for which the paper supply operation has been completed ($U_{N+1}=1$), the set number is set in the paper supply counter for processing the copy paper number for the copy paper in the multicopy mode (S30316). Then, the paper supply flag is set (S30317), the paper supply process (described later) is executed (refer to FIG. 25), and the routine returns.

When the depression of the print key is detected in S3031, the displayed number on the copy number display of the operation panel is set in the paper supply counter (S30319) in the same manner. If there is no original set on the platen glass 11 (S30320: NO), the original exchange flag and the insert flag are set at 1 (S30321). Then, the routine continues to S30317, and the paper supply is executed.

Similarly, if none of the sensors SA, SB, SC, or SD detects the feeding of the copy paper (S3032, S3033, S3034, S3035: NO), or if the feeding of the copy paper is detected but the sensor output signal edge timing is not on (S3036: NO), then it is determined that the previous copy paper has been preliminarily supplied and the routine continues to S30317 or S30318 to supply the next copy paper.

Figure 26:
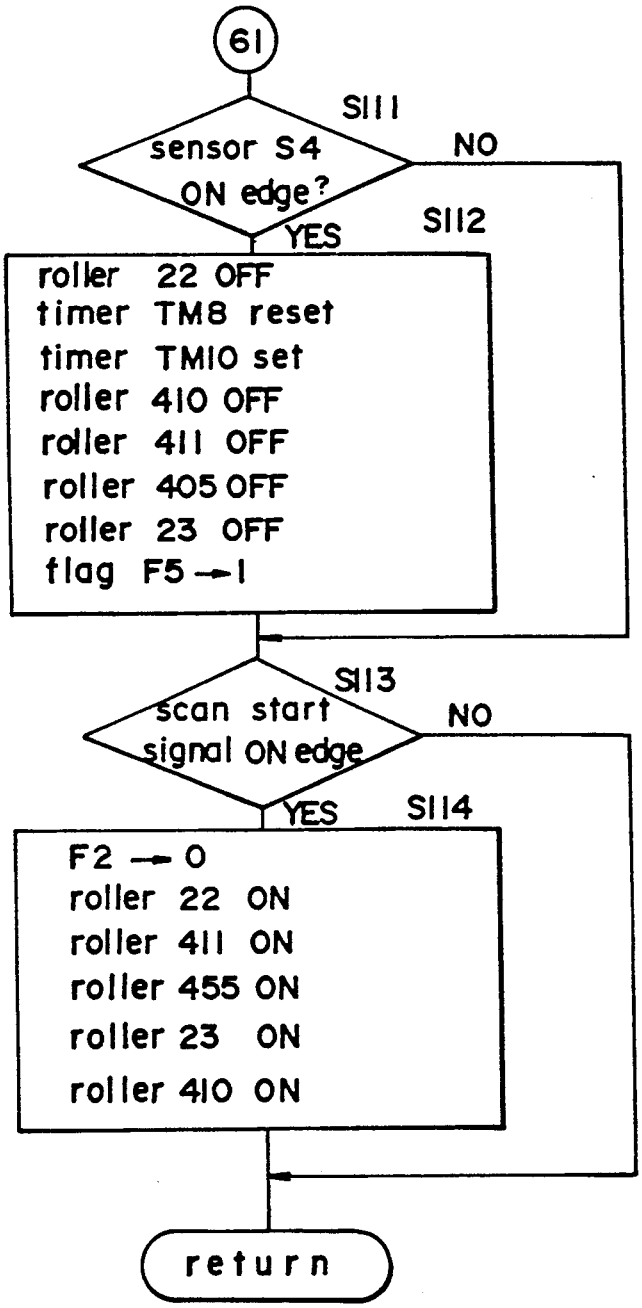
FIG. 26 is a flow chart showing a part of the paper supply process.

FIGS. 25 and 26 show details of the copy paper supply process (S30318).

First, a check is made to determine which paper cassette has been selected (S101), and the routine branches in accordance with the result of said determination. The paper supply process for each of the cassettes 401, 402, 403 and 404 are identical and, therefore, the following description describes only the process relative to the cassette 401.

When the trailing end of a previous copy paper passes the paper sensor SA which detects copy paper fed from the cassette 401, the paper sensor SA output is turned OFF, such that the completion of the feeding of the previous copy paper is confirmed via said paper sensor SA (S10). The start of the next copy paper supply uses a timer and may be set to start a predetermined interval after the detection of the trailing end of the previous copy paper via the sensor SA. Then, the paper supply flag F1 is set in S30318 (S103: YES), and when the timing roller 22 stop flag F5 is set (S104: YES), the routine continues to S105. That is, when it is determined that copy paper should be supplied in the paper supply information process (S303), and when the copy paper within the copying apparatus is in a state of being transported rather than in a stationary state due to the stopping of the timing roller 22, the paper supply flag F1 is reset, the timer TM7 is set (S105), and the paper supply roller 410 is operated to start the paper supply for the next original, whereupon the main motor is started (S106). If the reply to the query in any of the steps S102, S103 or S104 is NO, the routine immediately advances to S107.

Next, the paper sensor SA state is checked, and if the sensor SA is ON-edge (S107: YES), i.e., if the start of the paper supply has been detected, the following timers are set: the paper jam detection timer TM7, jam detection timer TM8 for detecting copy paper jams until arrival at the timing roller 22, and timer TM9 for determining the timing for stopping the drive mechanism of rollers other than the supply roller 410 (S108).

When the timer TM9 finishes (S109: YES), the paper supply roller 410 is stopped (S110).

When the state of the paper sensor S4, which detects the arrival of the copy paper at the timing roller 22, is checked and found to be ON-edge (S111: YES), the timing roller 22 is stopped and the timer TM8 is reset. Then, the discharge jam detection timer TM10, which detects paper jams in the discharge path, is set and the feed rollers 410, 411, transport roller 405, and intermediate roller 23 are stopped, and the timing roller stop flag F5 is set. The aforesaid procedure maintains a constant paper supply spacing and prevents jams caused by a following copy sheet overtaking a preceding copy sheet when the timing roller 22 is stopped.

A scan start signal is generated to start the scanning of the original (S113: YES), and the timing roller stop flag F2 is reset. Then, the timing roller 22, feed roller 411, transport roller 405, intermediate roller 23, and feed roller 410 are re-actuated (S114), and the copy paper is fed from the timing roller 22 while a copy paper is pre-supplied from the cassette 401.

Figure 27:
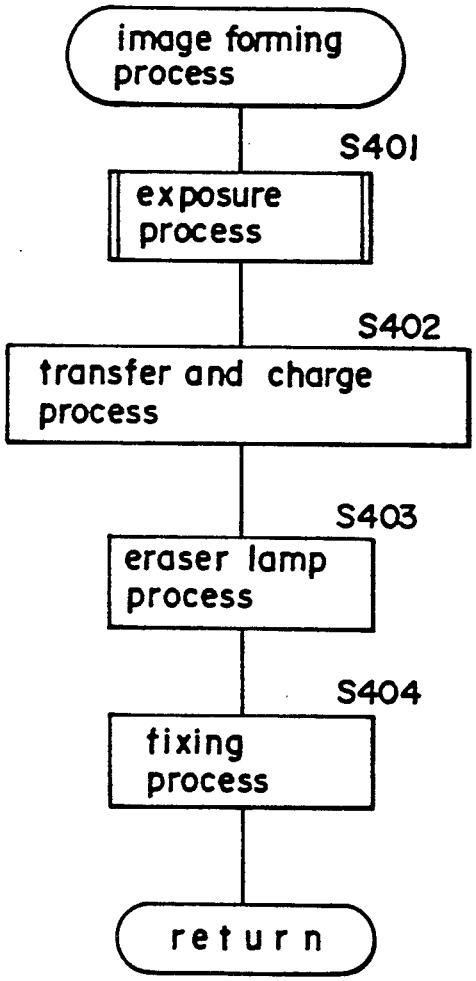
FIG. 27 is a flow chart showing the image forming process.

FIG. 27 shows details of the image forming process (S4). The image forming process comprises an exposure process for controlling the optical unit 10 (S401), transfer and charge process for controlling the transfer charger 2 and charger 5 (S402), eraser lamp process for controlling the eraser lamp 8 (S403), and a fixing process for controlling the temperature of the fixing roller 111 (S404). The exposure process (S401) is the process wherein the preliminary paper supply is accomplished and is described in detail hereinafter.

FIG. 28 shows details of the exposure process (S401). First, if the sensor S4 detects an original (S4011), the delivery of the copy paper the position of the timing roller 22 is determined. If an original is present on the platen glass 11 (set flag=1) (S4012: YES), the scanner control process is executed to operate the mirrors and lamps and the like of the optical unit 10 (S4013). Within this process, the scan finish control flag is set when the scanning is completed. This procedure. results in the displayed number being decremented (S4015) if the scan finish control flag is set (S4014: YES). If the displayed number is 0, the set number is set as the displayed number (S4017), and at the same time the exchange flag is set indicating an original exchange (S4018). Then, the exposure counter is decremented (S4019), and the routine returns. The aforesaid exposure counter is incremented when the copy paper is supplied, and decremented when the scanning is finished. When the scan finish control flag is not set in S4014, the routine returns without event.

When an original is not placed on the platen glass 11 (S4012: NO), i.e., when an original exchange is not currently on-going (S40110: NO), the displayed number portion of the exposure is accomplished. That is, when the blank paper discharge flag is not set (S40111: NO) and if the displayed number portion of the exposure is not finished (S40112: NO), the routine continues to S4013, whereas if the displayed number portion of the exposure is finished, the blank paper discharge flag is set (S40113). Then, the scanner control process is executed in accordance with the aforesaid settings (S40114), the blank paper discharge flag is reset when scanning is finished (S40116), and the routine returns. This time is the time wherein copy paper is supplied in excess of the displayed number, such that only the processes of steps S40113~S40116 are executed and the displayed number is not subtracted. When it is determined in S4011 that the scan finish control flag is not set, the routine returns without event.

Furthermore, when the copy paper is not at the timing roller position (S4011: NO), the routine immediately returns. In addition, if an original exchange is currently on-going (S40110: NO), the routine immediately returns.

What is claimed is:

1. A copying machine comprising:

automatic document handling device including a document tray, first transport means and second transport means, said first transport means feeding original documents placed on said document tray to a predetermined position located between said document tray and an image reading position and said second transport means further feeding original documents fed to the predetermined position by the first transport means to the image reading position;

detecting means for detecting the presence of original documents placed on the document tray;

feeding means for feeding a copy paper to a fixed position within a copy paper feeding path before the original document is fed to the image reading position by the second transport means;

first control means for controlling the feeding means so as to feed the copy paper corresponding to a third original document when the presence of said third original document disposed on the document tray is detected by said detecting means; and second control means for controlling said detecting means in order to detect the presence of the third original document disposed on the document tray after a second original document has been fed from said document tray to the predetermined position via said first transport means during the copying operation for a first original document fed to the image reading position via said second transport means.

2. A copying machine as claimed in claim 1 wherein said detecting means detects the presence of original documents placed on the document tray several times.

3. A copying machine as claimed in claim 2 further comprising:

prohibiting means for prohibiting the feeding means from feeding the copy paper corresponding to the third original document when non-presence of the third original document disposed on the document tray is detected a larger number of times than a predetermined number of times.

4. A copying machine comprising:

automatic document handling device including a document tray;

detecting means for detecting the presence of original documents placed on the document tray several times;

feeding means for feeding a copy paper to a predetermined position within a copy paper feeding path before the original document is fed to the image reading position by the second transport means;

control means for controlling the feeding means so as to feed the copy paper corresponding to a third original document when the presence of said third original document disposed on the document tray is detected by said detecting means; and prohibiting means for prohibiting said feeding means from feeding the copy paper corresponding to the third original document when non-presence of the third original document disposed on the document tray is detected a larger number of times than a predetermined number of times.

5. A copying machine as claimed in claim 4 wherein said automatic document feeder further including first transport means and second transport means, said first transport means feeding original documents placed on said document tray to a predetermined position located between said document tray and an image reading position and said second transport means further feeding original documents fed to the predetermined position by the first transport means to the image reading position.

6. A copying machine as claimed in claim 5 wherein said detecting means detects the presence of the third original document disposed on the document tray after a second original document has been fed from said document tray to the predetermined position via said first transport means during the copying operation for a first original document fed to the image reading position.

7. A method performed in a copying machine having an automatic document handling device including a document tray, said method comprising the steps of:

transporting a first original document placed on the document tray to a predetermined position located between said document tray and an image reading position via a first transport means, and further transporting said first original document to the image reading position via a second transport means;

transporting a second original document placed on the document tray to said predetermined position via said first transport means;

detecting the presence of a third original document placed on the document tray by means of detecting means after said second original document has been fed from said document tray to the predetermined position via said first transport means during the copying operation for said first original document fed to the image reading position; and feeding the copy paper corresponding to said third original when the presence of the third original disposed on the document tray is detected by said detecting means.

* * * * *